US008348732B2

(12) United States Patent
Aronstam et al.

(10) Patent No.: US 8,348,732 B2
(45) Date of Patent: Jan. 8, 2013

(54) AIRFLOW CONTROL SYSTEM

(75) Inventors: Peter S. Aronstam, Houston, TX (US); Roger W. Fincher, Conroe, TX (US)

(73) Assignee: Adaptive-AC, Inc., Houston, TX (US)

( * ) Notice: Subject to any disclaimer, the term of this patent is extended or adjusted under 35 U.S.C. 154(b) by 1710 days.

(21) Appl. No.: 11/610,625

(22) Filed: Dec. 14, 2006

(65) Prior Publication Data

US 2007/0178823 A1 Aug. 2, 2007

Related U.S. Application Data

(63) Continuation-in-part of application No. 10/987,476, filed on Nov. 12, 2004, now Pat. No. 7,347,774.

(60) Provisional application No. 60/750,579, filed on Dec. 15, 2005.

(51) Int. Cl.
*F24F 7/00* (2006.01)

(52) U.S. Cl. ..... 454/256; 236/49

(58) Field of Classification Search ..... 454/256; 236/49.3, 51

See application file for complete search history.

(56) References Cited

U.S. PATENT DOCUMENTS 5,271,558 A * 12/1993 Hampton ..... 236/49.3
5,364,304 A 11/1994 Hampton
5,449,112 A 9/1995 Heitman et al.
5,533,668 A 7/1996 Erikson
5,927,599 A 7/1999 Kath
6,338,677 B1 1/2002 White
6,364,211 B1 4/2002 Saleh
6,659,359 B2 12/2003 Kwak
6,692,349 B1 2/2004 Brinkerhoff et al.
6,798,341 B1 9/2004 Eckel et al.
2002/0058473 A1 5/2002 Park
2004/0182941 A1 9/2004 Alles
2004/0194484 A1 10/2004 Zou et al.
2004/0238653 A1 12/2004 Alles
2005/0127196 A1 6/2005 Gottlieb
2005/0161517 A1 7/2005 Helt et al.

OTHER PUBLICATIONS

Cynthia M. Davis, Editor; "Zoning", Home Electronic Ideas; Winter 2004; pp. 122-124; vol. 2 No. 4; EH Publishing Inc.; Framingham, Mass.

EH Publishing Inc.; "Electronic Home Magazine—Climate Control"; website-webpage www.electronichouse.com; 2004; EH Publishing Inc.; Framingham, Mass.

Suncourt Inc.; "Equalizer EQ2 Register Booster Fan"; website-webpage www.suncourt.com/EQ2.html 2004; Suncourt Inc.; Durant, Iowa.

* cited by examiner

*Primary Examiner* — Steven B McAllister
*Assistant Examiner* — Helena Kosanovic
(74) *Attorney, Agent, or Firm* — Patterson & Sheridan, L.L.P.

(57) ABSTRACT

The present invention is generally directed to an apparatus and a method for controlling an environment in a location. In one aspect, an apparatus for controlling an environmental condition in a location is provided. The apparatus includes a flow control device, wherein the flow control device is connectable to an environmental control unit via a conduit. The flow control device comprising a flow restriction member configured to selectively control an airflow into the location and a controller member configured to autonomously actuate the flow restriction member based upon the environmental condition in the location. In another aspect, a method for controlling an environmental condition in a first location and a second location is provided. In a further aspect, a system for controlling an environmental condition in a first location and a second location is provided. In yet a further aspect, a method for controlling an environmental condition in a location is provided.

17 Claims, 23 Drawing Sheets

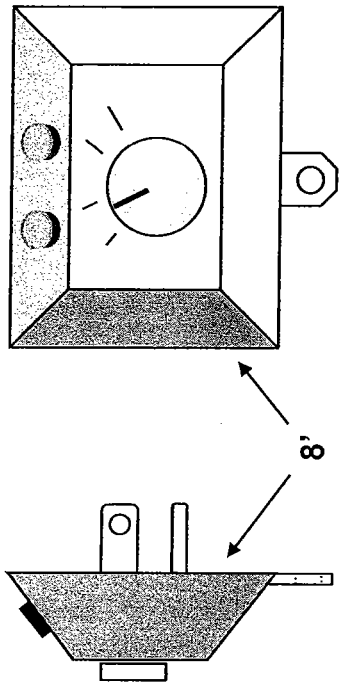
Figure 13
Figure 14
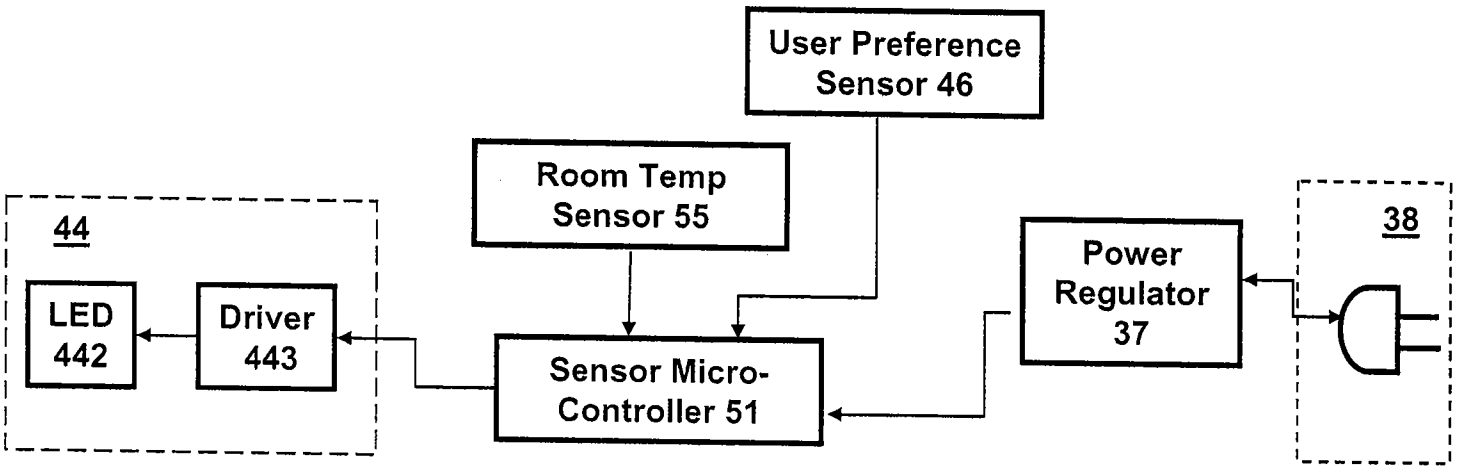
Figure 15

AIRFLOW CONTROL SYSTEM

CROSS-REFERENCE TO RELATED APPLICATIONS

This application is a continuation-in-part of U.S. patent application Ser. No. 10/987,476, filed on Nov. 12, 2004, now U.S. Pat. No. 7,347,774 and this application also claims benefit of U.S. provisional patent application Ser. No. 60/750,579, filed Dec. 15, 2005. Each of the aforementioned related patent applications is herein incorporated by reference.

BACKGROUND OF THE INVENTION

1. Field of the Invention

Embodiments of the present invention generally relate to heating, ventilating, and air conditioning systems. More particularly, the invention relates to controlling an environmental condition in a location.

2. Description of the Related Art

The typical air vents in commercial and residential settings consist of louvers which may be manually opened or closed in varying degrees. These air vents provide a limited ability to adjust the amount of airflow into a room or area, the air coming from a central environmental control unit, such as a furnace, central air conditioner, or dehumidifier. There may be several such vents connected, via ducts, to the central environmental control unit, each vent providing airflow to a room or area. Since these vents are generally connected to a central unit, the opening or closing of one or more vents affects the airflow to the other vents. If it is desired to restrict the flow of air in a single area or room, then the other rooms or areas are affected. To restrict the flow to a room or area, the vent for that room or area must be manually adjusted. Furthermore, a single thermostat typically controls the operation of the environmental control unit. If that thermostat is in the room or area where the airflow is adjusted, then the temperature and climate of the other rooms or areas are affected. The temperature and climate of the other rooms or areas are affected even if the thermostat is not in the room or area were the airflow is adjusted, owing to the fact that the ratios of airflow between the remaining vents are altered by the opening or closing of any of the vents. This usually leads to the need to readjust all vents if any one of the vents is opened or closed, a process which may require several iterations to perfect, and then only for the specific conditions at the time the adjustment was made. Further, if one overly restricts airflow by closing too many vents, damage to the environmental control unit may occur.

In cases where the vent to be adjusted resides in a tall ceiling, the user must climb a ladder or use a stick to open and close the vent. This can be an inconvenience especially in situations where a user wishes to open or close a vent at multiple times during the day to account for changes in solar influx or room use pattern. In one example, a user wishes to keep certain vents restricted during the night to conserve energy, such as to emphasize the vents in the sleeping quarters, and then close them during the day. A further complication occurs when a user wishes to boost the heating or cooling in a specific room. With a conventional AC system, the only way to boost a given room is to restrict flow in other rooms, requiring that the user change multiple vent controls in other rooms to accomplish the user's goals.

This problem has been partially addressed with various remote-controlled vent louvers. A user may install a vent louver that is powered by being wired to a source of electricity or by batteries. The remote control allows the user to point at the vent to open or close the vent. Such a configuration reduces the need for manually adjusting the vent, but either method requires wiring through the system or periodic battery replacement. A further restriction of these devices is that they are operated independently, but still affect each other as it relates to cooling, heating, humidity, or to control complex multi-room issues.

SUMMARY OF THE INVENTION

The present invention is generally directed to an apparatus and a method for controlling an environment in a location. In one aspect, an apparatus for controlling an environmental condition in a location is provided. The apparatus includes a flow control device, wherein the flow control device is connectable to an environmental control unit via a conduit. The flow control device includes a flow restriction member configured to selectively control an airflow into the location and a controller member configured to autonomously actuate the flow restriction member based upon the environmental condition in the location.

In another aspect, a method for controlling an environmental condition in a first location and a second location is provided. The method includes placing a first flow control device within the first location and a second flow control device within the second location. The method further includes controlling the environmental condition in each location by autonomously controlling airflow through each flow control device. The method also includes sending a signal from the first flow control device to the second flow control device via a duct system that interconnects the flow control devices. Additionally, the method includes detecting the signal in the second flow control device and adjusting the airflow through the second flow control device.

In a further aspect, a system for controlling an environmental condition in a first location and a second location is provided. The system includes a first flow control device and a first sensor member disposed within the first location, the first sensor member configured to sense and send environmental data regarding the first location to the first flow control device. Additionally, the system includes a second flow control device and a second sensor member disposed within the second location, the second sensor member configured to sense and send environmental data regarding the second location to the second flow control device, wherein each flow control device includes a flow restriction member and a controller member configured to autonomously actuate the flow restriction member.

In yet a further aspect, a method for controlling an environmental condition in a location is provided. The method includes placing a flow control device within the location, wherein the flow control device is connected to an environmental control unit via a conduit. The method further includes comparing the environmental condition to an environmental condition parameter. Additionally, the method includes controlling the environmental condition in the location by autonomously controlling airflow through the flow control device based upon a difference in the environmental condition and the environmental condition parameter.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 13 shows a side view illustrating an AC line powered sensor module;

FIG. 14 shows a front view illustrating an AC line powered sensor module;

FIG. 15 shows a schematic view illustrating an AC line powered sensor module;

DETAILED DESCRIPTION

The present invention is generally directed to a method and apparatus for controlling the flow of a fluid through a heating, ventilating, and air conditioning system. Various terms as used herein are defined below. To the extent a term used in a claim is not defined below, it should be given the broadest definition persons in the pertinent art have given that term, as reflected in printed publications and issued patents. In the description that follows, like parts are marked throughout the specification and drawings with the same number indicator. The drawings may be, but are not necessarily to scale, and the proportions of certain parts have been exaggerated to better illustrate details and features of the invention. One of ordinary skill in the art of a heating, ventilating, and air conditioning system will appreciate that the embodiments of the invention can and may be used in various types of flow control systems.

Figure 1:
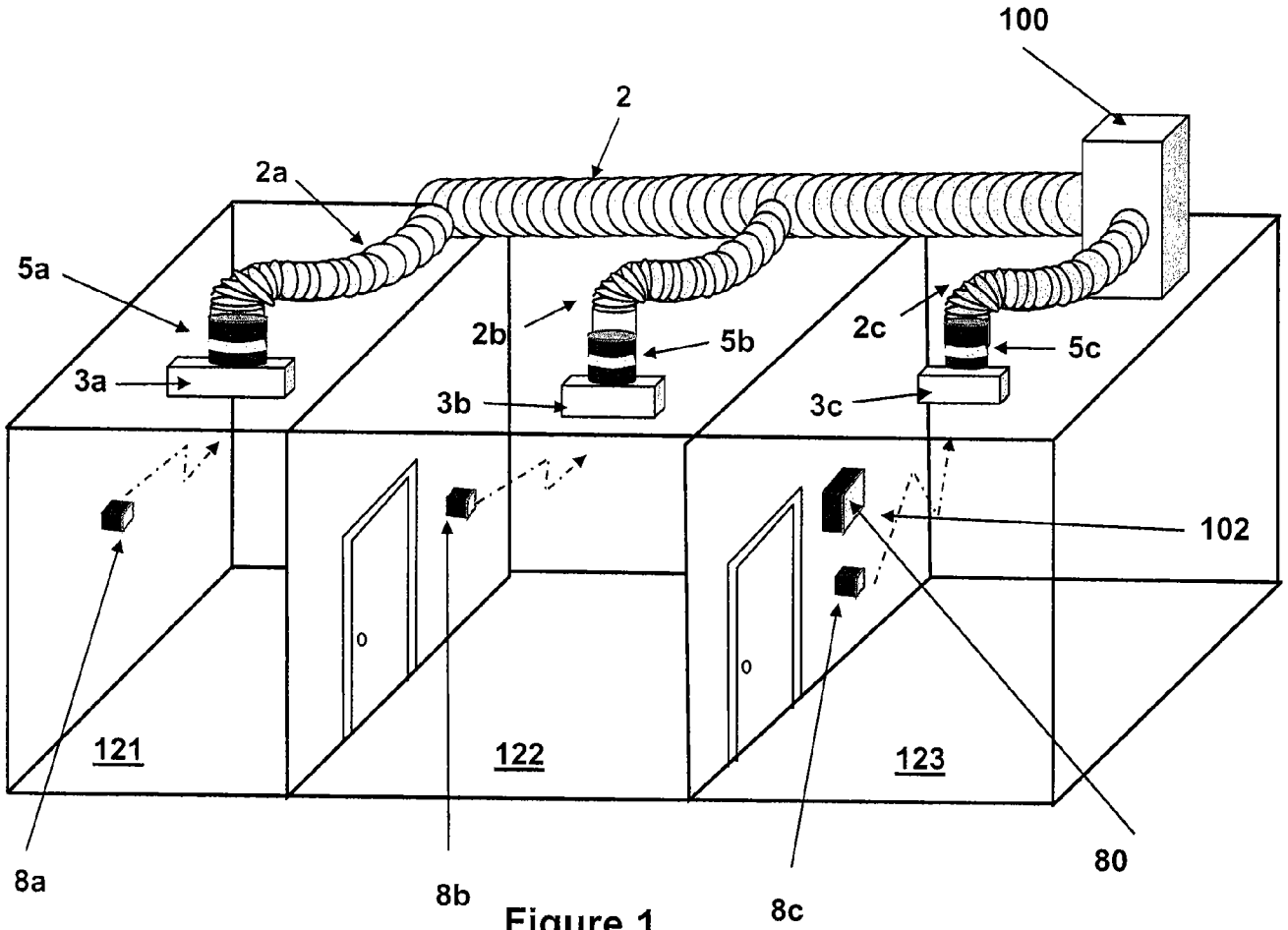
FIG. 1 shows a diagrammatic view illustrating the present invention in the context of a typical application.

FIG. 1 illustrates an environmental control system 20. Generally, the environmental control system 20 is used to maintain a predetermined environment in a room. For ease of explanation, the invention will be described generally as it relates to a single building structure having three rooms. It is to be understood, however, that the invention may be employed in any number of building structures or any type of environmental control structure without departing from principles of the present invention.

As shown in FIG. 1, the environmental control system 20 includes an environmental control unit 100 which delivers heated, cooled, or dehumidified air through ductwork 2 into rooms 121, 122, 123 by way of register boxes 3*a, b, c* and register grills 4*a, b, c*. Ductwork 2 can be any system of conduits capable of transferring conditioned air from an environmental control unit to rooms. Rooms 121, 122, 123 can be any space or zone where environmental control is desired. Environmental control unit 100 can be any one of a number of devices such as a HVAC unit, a dehumidifier, a furnace, an evaporative cooling unit, or other such air conditioning devices. Central controller 80, as show by example to be located in room 123, regulates the operation of environmental control unit 100. Central controller 80 can be a thermostat, humidity controller, timer, or any of many devices typical of controlling an environmental control unit.

Figure 2:
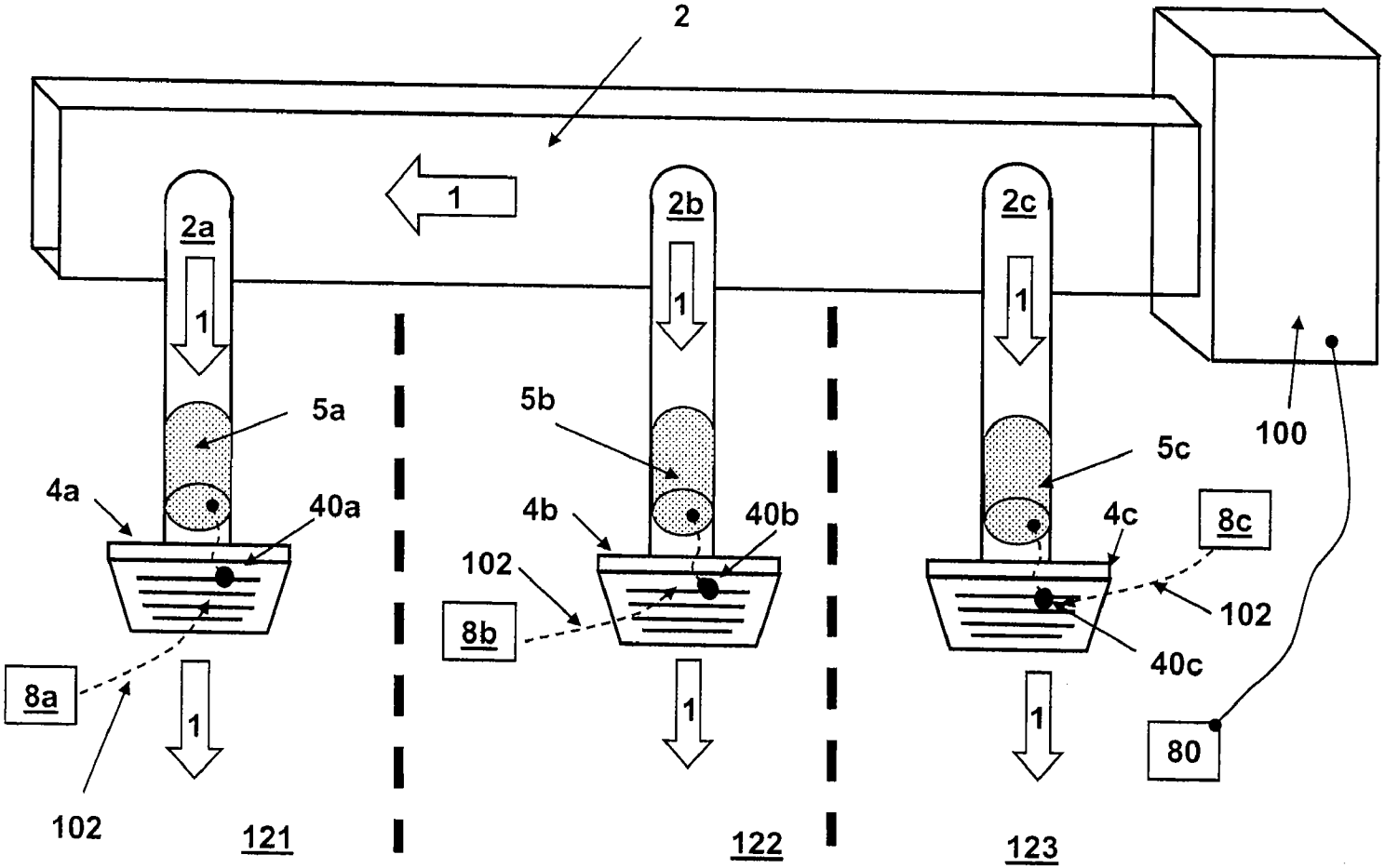
FIG. 2 shows a 3-D perspective view illustrating the use of sensors and positioning of flow control devices.

FIG. 2 illustrates an enlarged view of the environmental control system 20. As shown, the environmental control unit 100 is connected to ductwork 2 and controlled by central controller 80. Ductwork branches 2*a*, 2*b*, 2*c* extend from ductwork 2 to one or more rooms 121, 122, 123. Central controller 80 may be placed in one room 123, and is in communication with environmental control unit 100. One or more flow control devices 5*a*, 5*b*, 5*c* are installed in respective ductwork branches 2*a*, 2*b*, 2*c*. Register grills 4*a*, 4*b*, 4*c* are attached to the termination of ductwork branches 2*a*, 2*b*, 2*c*, respectively. Flow control devices may be installed as shown within the ductwork, ductwork branches, or alternatively installed at the termination of the ductwork branches. Communications devices 40*a*, 40*b*, 40*c* are mounted on register grills 4*a*, 4*b*, 4*c*, respectively, and electrically connected to respective flow control devices 5*a*, 5*b*, 5*c*. Communications devices may be either receivers or transceivers as the application warrants and may be implemented by any typical wireless or wired system, for example, infra red, 802.11 spread spectrum, digital cable, RS-232, modem, ultrasonic, ×10, Zigbee, Bluetooth, instrumentation bus, or other wire or wireless methods and protocols, and any combination thereof. Sensors 8*a*, 8*b*, 8*c* are located within rooms 121, 122, 123 and transmit data to communications devices 40*a*, 40*b*, 40*c*. Sensors 8*a*, 8*b*, 8*c* capture the rooms' environmental condition which may include temperature, humidity, date, day, time of day, use, proximity of inhabitants, or user desired environmental condition, such as desired temperature, or priority. Sensor data stream 102*a*, 102*b*, 102*c* are passed from sensors 8*a*, 8*b*, 8*c* to the flow control devices 5*a*, 5*b*, 5*c* by way of the communications devices 40*a*, 40*b*, 40*c*, respectively. Sensor data streams may contain summaries of all data collected by the sensors regarding the environmental condition of the room and/or user request data.

Figure 3:
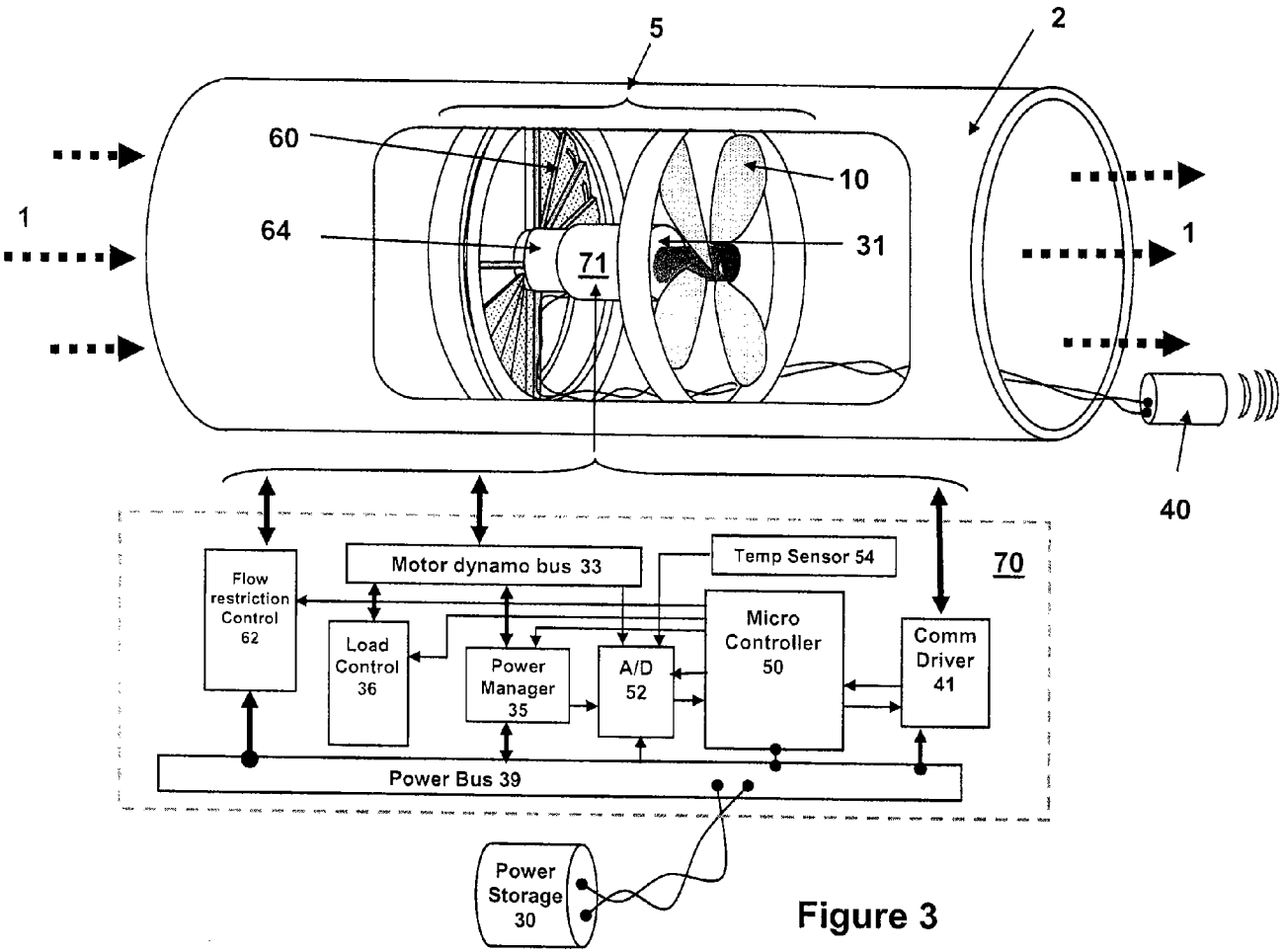
FIG. 3 shows a 3-D perspective view illustrating a flow control device with petal valve as installed in ductwork with a schematic view of an intelligent controller.

FIG. 3 is a detailed illustration of a typical flow control device 5 as mounted in duct 2. A flow control device contains rotating structure 10, such as a propeller, turbine, or any structure which is capable of being moved by the airflow passing through the unit. Rotating structure 10 is axially connected to motor-dynamo 31, such as a brush, or brushless motor, or alternator/generator, or any device providing the means of generating power from the rotating structure. The combination of the rotating structure 10 and the motor dynamo 31 provides the flow control device 5 with the means to generate power, means to boost flow, and a means to restrict flow. In other words, the combination of the rotating structure 10 and the motor dynamo 31 allows the flow control device 5 to be an autonomous device. Motor-dynamo 31 is axially connected to intelligent controller housing 71. Stepper motor 64 is axially connected to intelligent controller housing 71. The stepper motor 64 can be any device capable of actuating a flow restricting device. The stepper motor 64 is axially aligned with restriction member 60. Restriction member 60 could be any valve structure capable of reducing flow though flow control device 5, such as a petal valve. Restriction member 60 provides a means of flow restriction. These means to restrict flow enable various intermediate values between full open and full closed, allowing partial restriction of airflow through the duct. The whole assemblage of the flow control device 5 is firmly fit within duct 2.

Within intelligent controller housing 71 are located intelligent controller 70 and power storage device 30. Communications device 40 is connected by wires to intelligent controller 70, and is situated preferably downstream of flow control device 5. Flow control device 5 is preferably oriented such that restriction member 60 is located upstream of rotating structure 10. It should be noted however, that restriction member 60 may be located downstream of the rotating structure 10 without departing from the principles of the present invention.

Intelligent controller 70 comprises multiple electrical subsystems providing the means to adaptively control flow in duct 2. Intelligent controller 70 is typically a printed circuit card or integrated electronic chip. Motor-dynamo 31 is electrically connected to motor-dynamo bus 33 of intelligent controller 70. The motor-dynamo bus 33 allows multiple circuit subsystems to transfer electrical energy to or from the motor dynamo 31 as required for proper functioning. Motor-dynamo bus 33 is electrically connected to power manager 35. Power manager 35 is electrically connected to power bus 39. Power bus 39 is connected to power storage device 30. The power manager 35 acts as a bi-directional switch and power regulator between the motor-dynamo bus 33 and the power bus 39. The power bus 39 provides a delivery conduit for electrical energy to all circuit subsystems in intelligent controller 70. Alternatively, the circuit subsystems may be powered by independent means. Stepper motor 64 is electrically connected to flow restriction control 62. The flow restriction control 62 is electrically connected to power bus 39. The flow restriction control 62 controls the flow of electrical energy to stepper motor 64, and actuating restriction member 60. Communications device 40 is electrically connected to communications driver 41. Communications driver 41 is electrically connected to power bus 39. Power bus 39 is electrically connected to the microcontroller 50. Microcontroller 50 is logically connected to and controls the operation of communications driver 41. Communications driver 41 manages the data sent to or received from communications device 40. Microcontroller 50 is logically connected to and controls the operation of flow restriction control 62. Microcontroller 50 is logically connected to and controls the operation of load control 36. Microcontroller 50 is logically connected to and controls the operation of power manager 35. Microcontroller 50 is logically connected to and controls the operation of analog to digital converter 52. The analog to digital converter returns data to the microcontroller 50. Analog to digital converter 52 receives a data signal from temperature sensor 54 indicating the current temperature of the air in duct 2. Analog to digital converter receives a data signal from power bus 39 representing the charge level of the power storage device 30. Analog to digital converter 52 receives a data signal from power manager 35. Analog to digital converter 52 receives a data signal from motor-dynamo bus 33 indicative of the flow in duct 2. Alternatively analog to digital converter 52 function could be distributed into the various circuit subsystems allowing digital signals to be presented directly to microcontroller 50.

Figure 4:
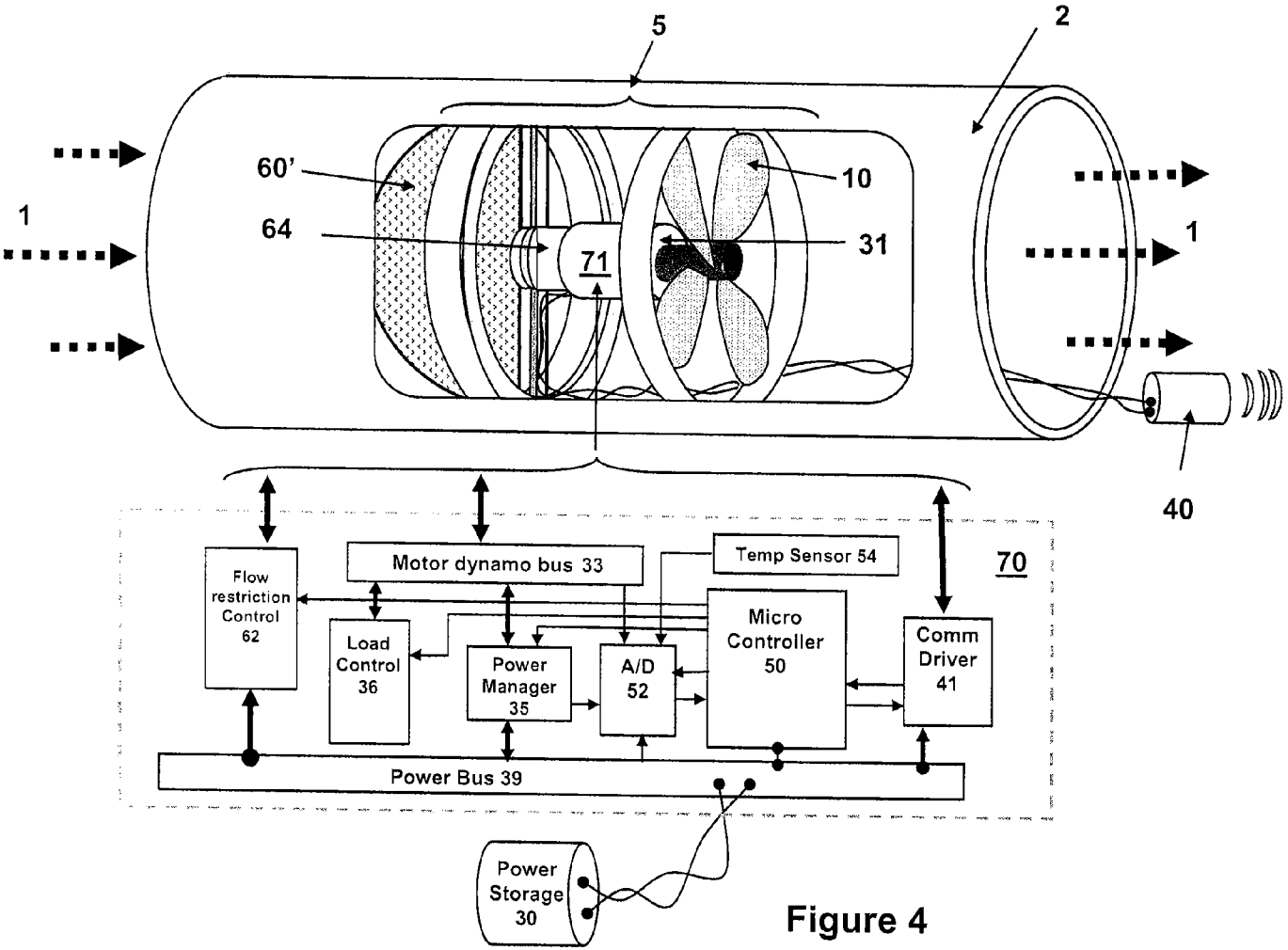
FIG. 4 shows a 3-D perspective view illustrating a butterfly valve embodiment of a flow control device as installed in ductwork with a schematic view of an intelligent controller.

FIG. 4 is a detailed illustration of one of embodiment flow control device 5 where the flow control means is implemented with butterfly valve 60'. For convenience, the components in FIG. 4 that are similar to components in FIG. 5 will be labeled with the same reference indicator.

Figure 5:
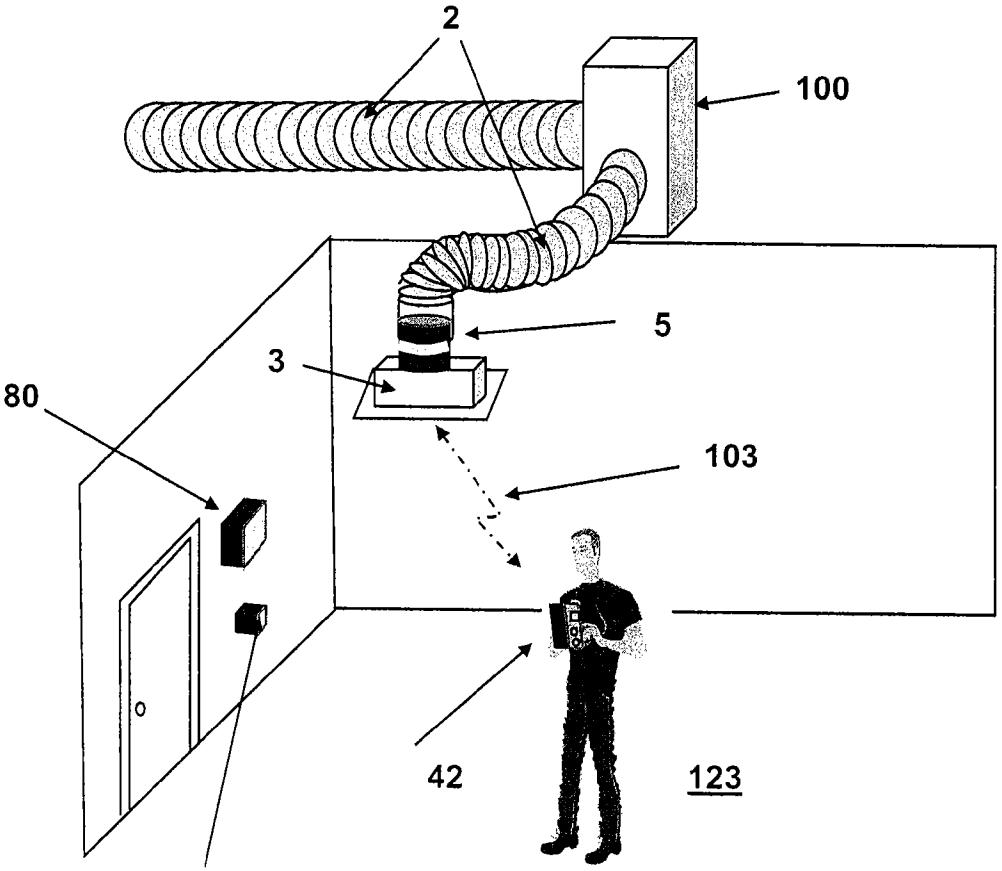
FIG. 5 shows a 3-D perspective view illustrating use of a remote programming device to change programming instructions in a flow control device.

FIG. 5 shows a user using a remote programming device 42 to transmit remote program instructions 103 to flow control device 5 in room 123. This method could also be used to select the target operating environmental conditions the user wishes to maintain. Alternately, input of the functional requests of the user can be built in to sensor unit 8. Each flow control device 5 behaves according to preprogrammed instructions in microcontroller 50. Many of these scenarios or behaviors are preprogrammed and only need to be selected by the user; while others may require uploading by the user.

Figure 6:
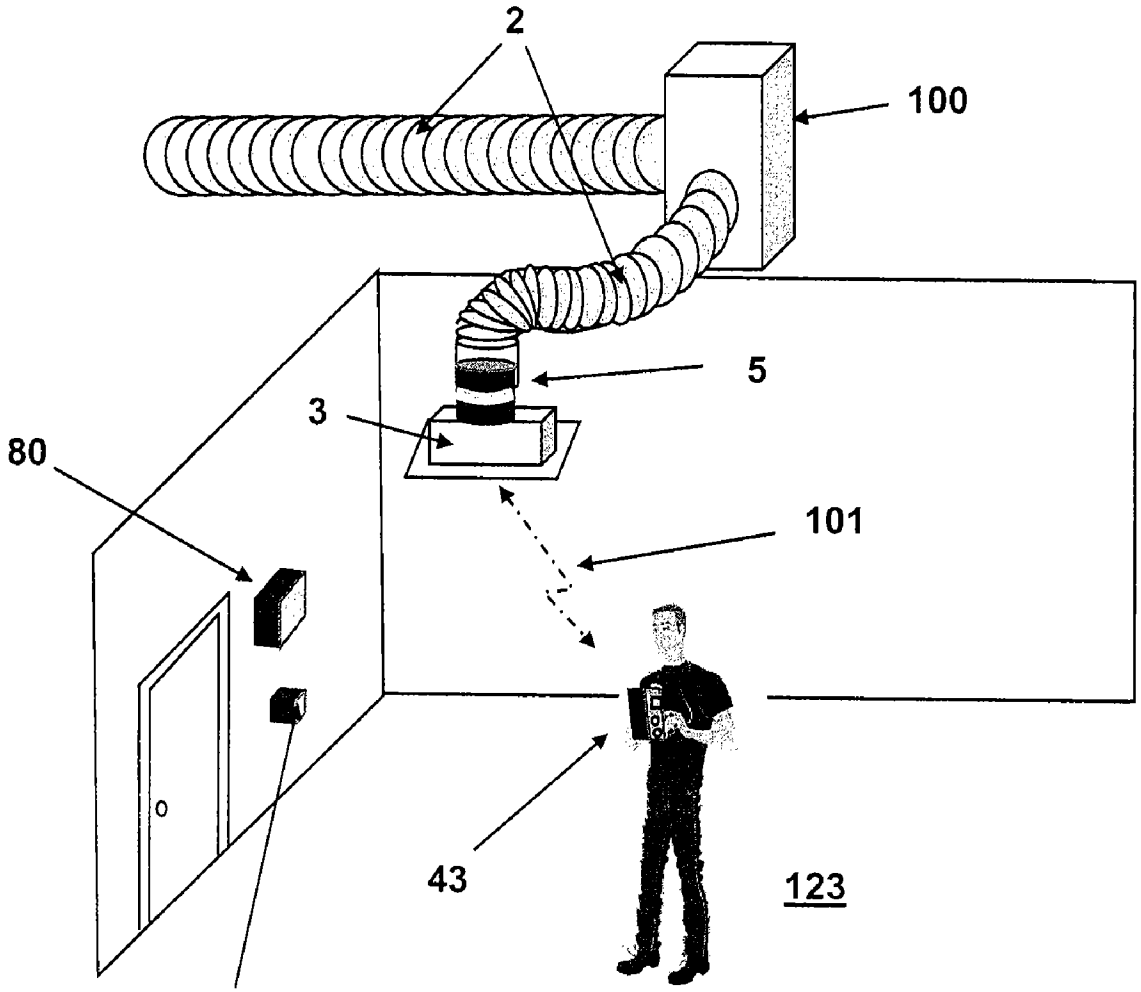
FIG. 6 shows a 3-D perspective view illustrating use of a remote polling unit 43 to extract parameters from a flow control device.

In another embodiment, illustrated in FIG. 6, the means to communicate, such as communications device (not illustrated), is bidirectional allowing a polling means whereby a user or technician may request one or more parameters from flow control device 5. The requested parameters can be any information relating from the operational data image 101 of the flow control unit 5, which includes its recent operating history which are downloaded into the remote polling unit 43.

In an another embodiment, not illustrated, the means to communicate, such as communications device 40, further comprises a status indication means to indicate operational status to the user. This may include indicating low power reserve, amount of flow restriction, amount of flow boost, failure conditions, or other parameters from operational data image 101 or data stream 102. The means to communicate may be transmitted in a wide variety of ways, typically as data through a wireless transceiver or indicated by lighting a light emitting diode, which can be seen at register grill 4.

Figure 7:
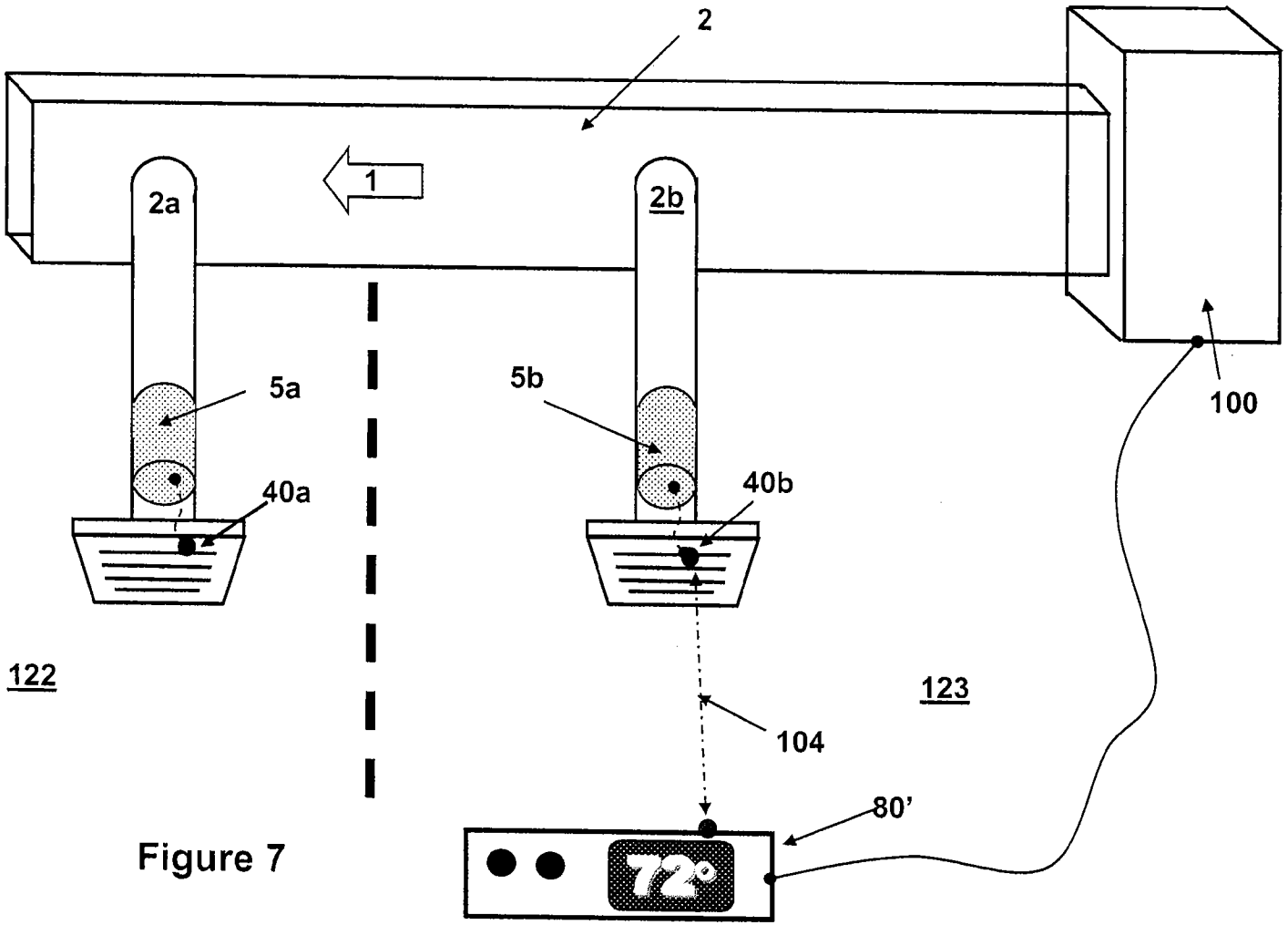
FIG. 7 shows a diagrammatic view illustrating the present invention in the context of transmitting environmental control unit commands to a central controller.

In the embodiment illustrated in FIG. 7, at least one flow control device 5*b* sends an environmental control unit command to its communications device 40*b*. Communications device 40*b* transmits environmental control unit command 104, which is received by central controller 80'. Central controller 80' responds to the received environmental control unit command 104, thereby modifying the operation of environmental control unit 100. This allows the plurality of flow control devices to effectuate a request to the environmental control unit to change states if preprogrammed conditions occur.

Figure 8:
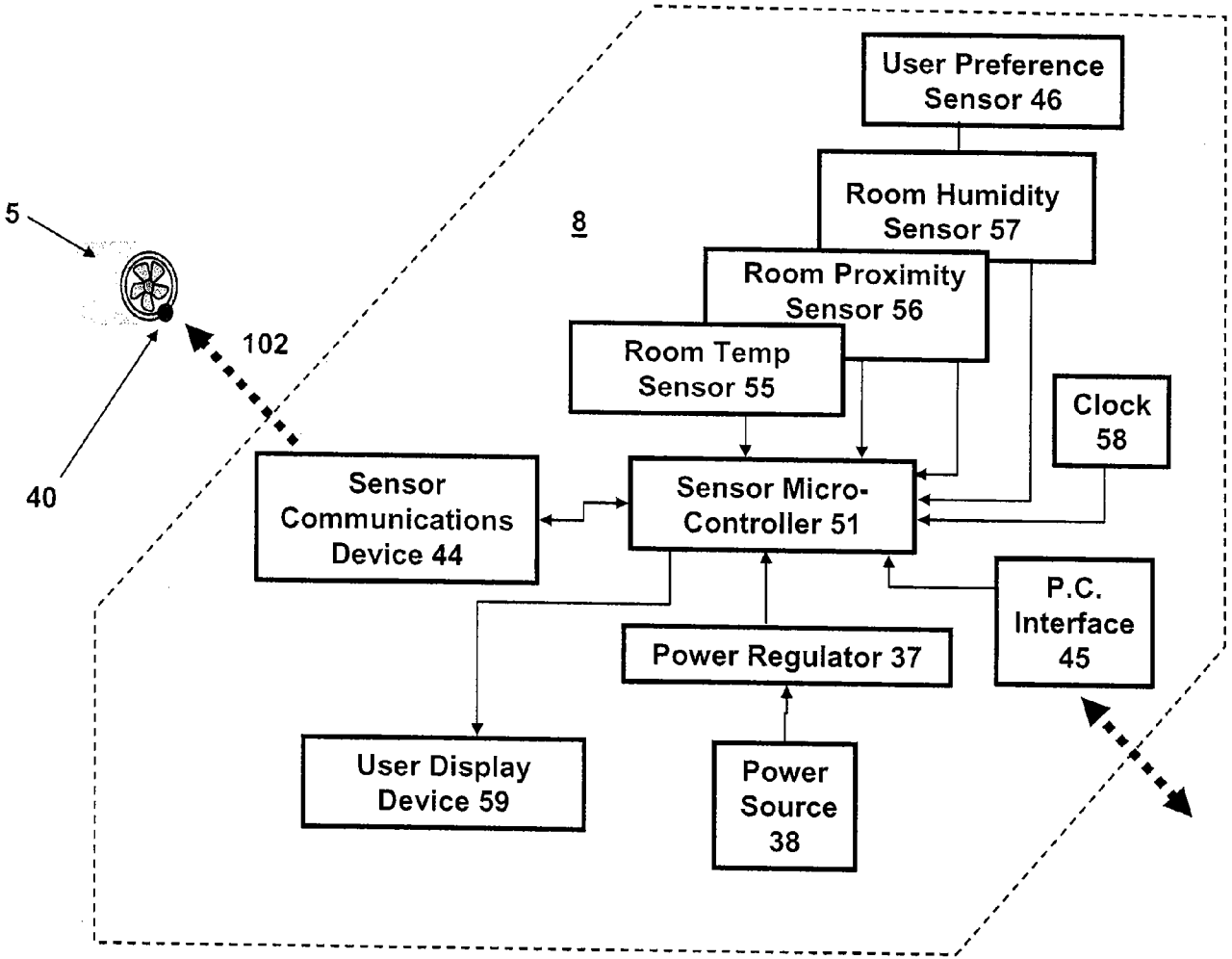
FIG. 8 shows a 3-D perspective view illustrating a communications device with a schematic view of a sensor.

FIG. 8 illustrates sensor 8. Sensor 8 comprises sensor communications device 44. Sensor communications device 44 transmits data stream 102 to communications device 40 of a flow control device 5. Sensor communications device 44 may be any typical wireless or wired system using infra red, 802.11 spread spectrum, ultrasonic, X10, Zigbee®, Bluetooth®, instrumentation bus, or other wire or wireless methods and protocols, and any combination thereof, which is able to communicate with communications device 40. Sensor communications device 44 electrically connects to sensor microcontroller 51, which is powered by power source 38 by way of power regulator 37. Sensor microcontroller 51 is connected to one or more sensor devices, such as room temperature sensor 55, room proximity sensor 56, and room humidity sensor 57, and user preference sensor 46. These various sensor devices may be based on any of a number of sensing means, such as infra-red, acoustic, resistive, semiconductor junctions, capacitive, inductive, received timing signals, switch setting, or position. A user preference sensor 46 may be a settable thermostat, digital keypad, or other means of user input. Sensor microcontroller 51 converts the signals sensed by the various sensor devices, preparing data stream 102 for transmission to communications device 40 by way of sensor communications device 44. Sensor microcontroller 51 may receive programming instructions and user preferences such as temperature and priority via a P.C. interface 45 and may have access to the current time via a clock 58.

Figure 9:
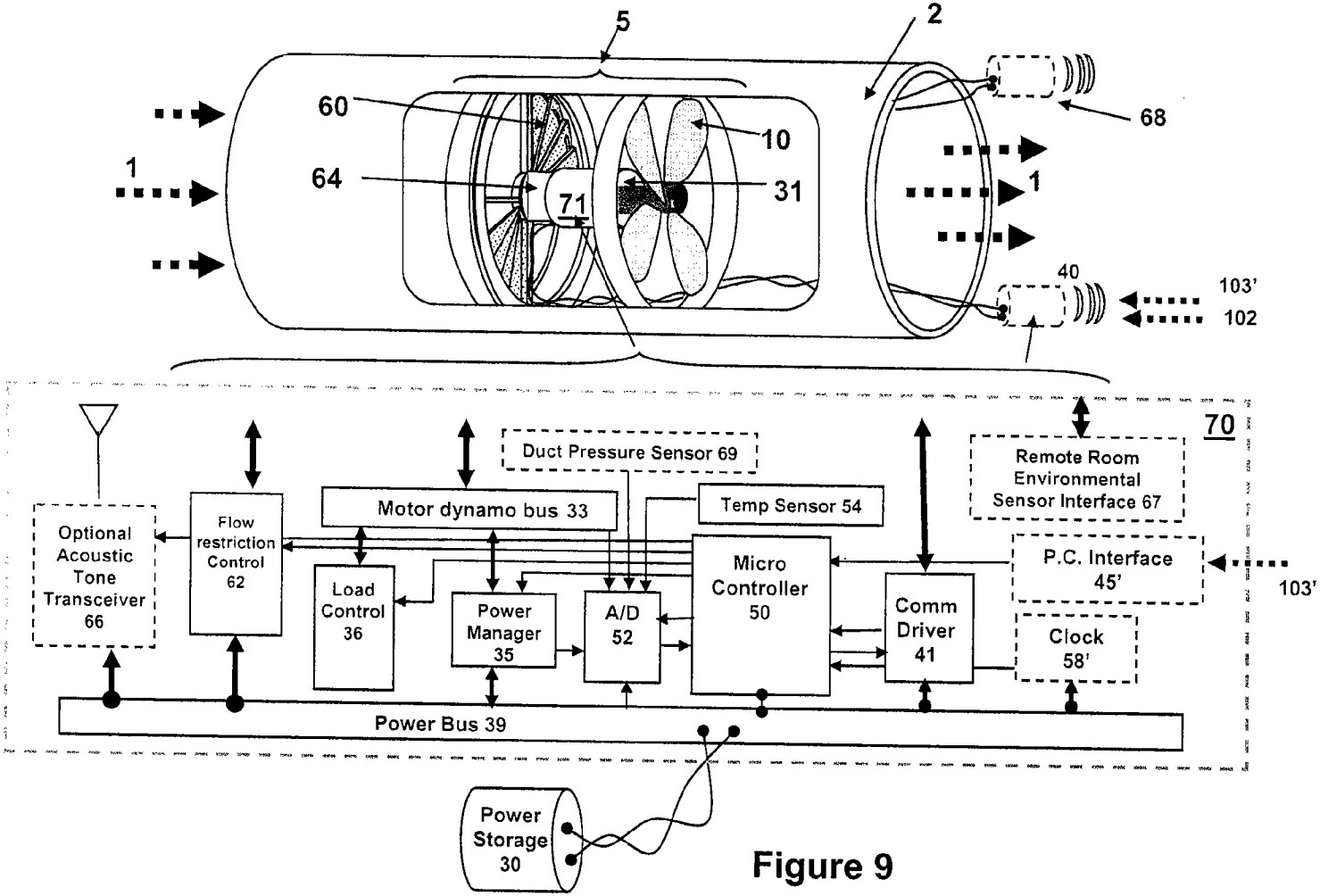
FIG. 9 shows a 3-D perspective view illustrating an alternative embodiment of a flow control device containing an acoustic transceiver, remote room environmental sensor interface, P.C. interface, and a duct pressure sensor within the intelligent controller.

In another embodiment, as shown in FIG. 9, a remote environmental sensor 68, such as an infra-red laser sensor capable of scanning the served room for the necessary physical parameter to provide environmental data for the sensor data stream 102 can be installed in flow control device 5. This reduces the need for a separate sensor 8, separately installed in the room. Such environmental sensors may be incorporated within the means to communicate, such as communications device 40.

Figure 10:
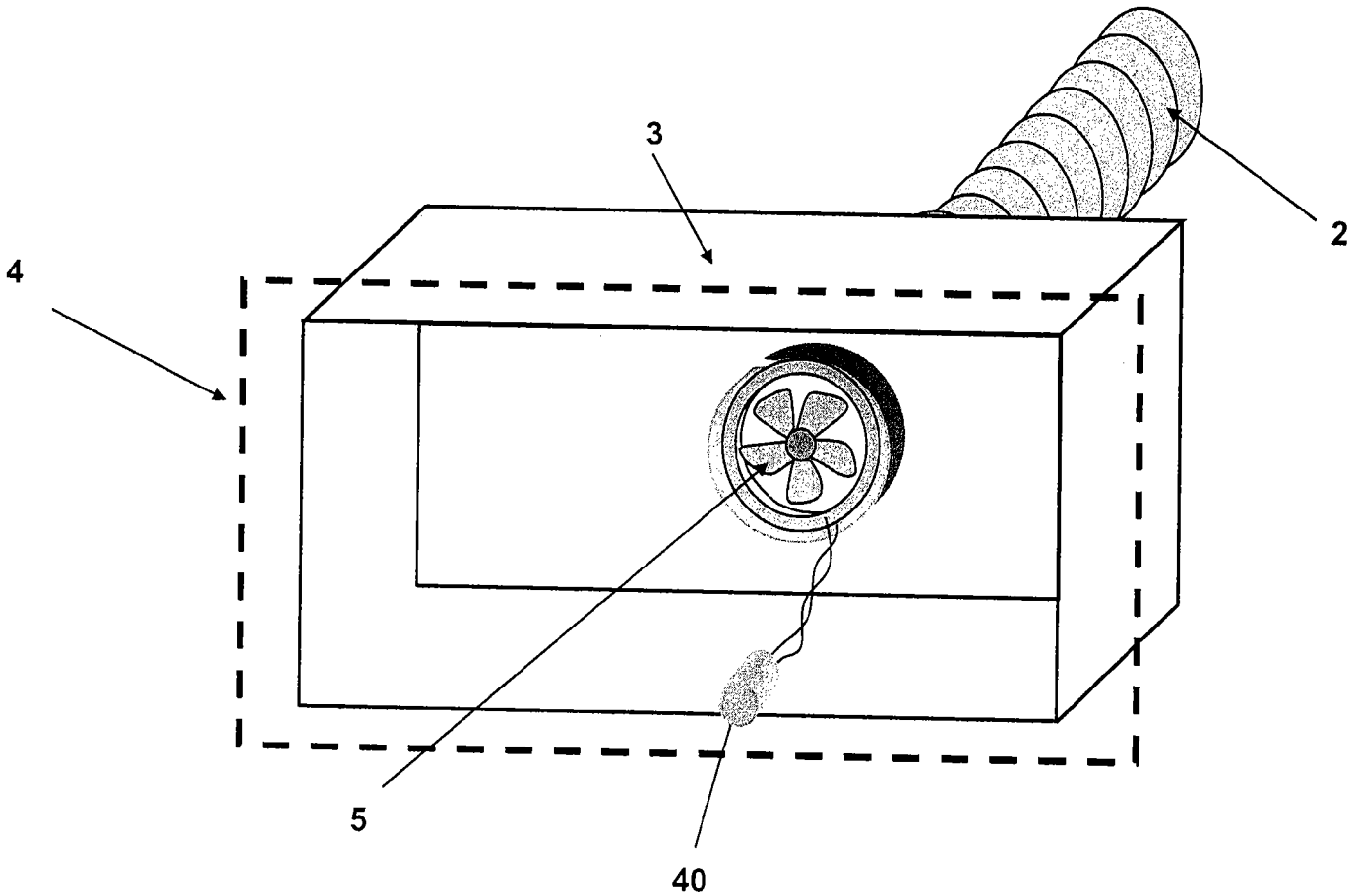
FIG. 10 shows a 3-D perspective view illustrating a method of installing the present invention in a circular duct.

As illustrated in FIG. 10, flow control device 5 of the present invention may be constructed and arranged to fit into a standard circular air duct, such as 4", 6", 8", or any other diameter. With this configuration, register grill 4 may be removed to expose register box 3 and a flow control device 5 inserted within the interior of the duct 2. Flow control device 5 may be placed within the air duct by means of a friction fit, adhesive, Velcro®, or other affixing means. Register grill 4 may be reattached, thus not changing the exterior decorative style. In the preferred embodiment, no wires need to be attached or connected to the air vent of the present invention, as the signals to open or restrict airflow will be sent to the communication interface means by use of wireless signals. Some installations may require that communications device 40 be attached to the front of register grill 4 using a simple extension cable.

Figure 11:
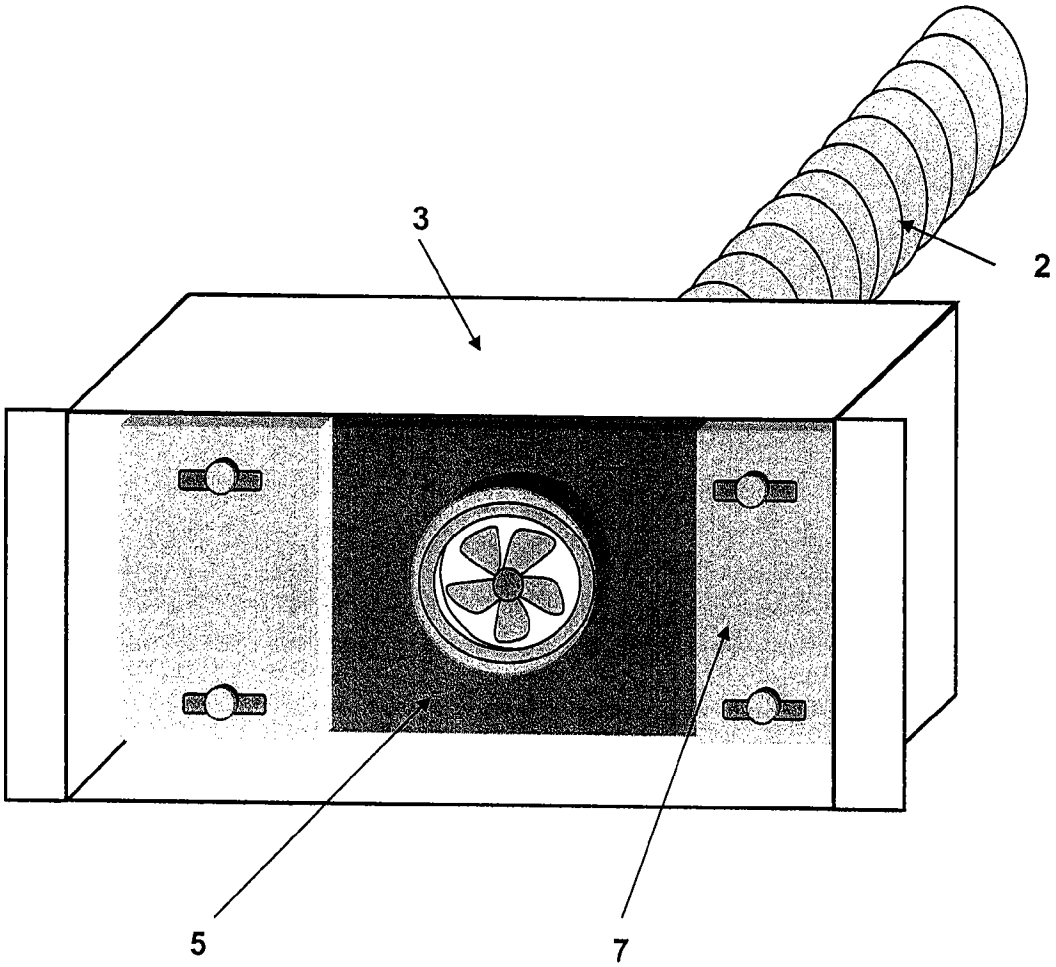
FIG. 11 shows a 3-D perspective view illustrating a method of installing the present invention in a register box.

As illustrated in FIG. 11, adjustable size bracket 7 is used to affix flow control device 5 within register box 3. This method of installation may be used in the event there are obstructions in duct 2 near its termination into register box 3.

Figure 12:
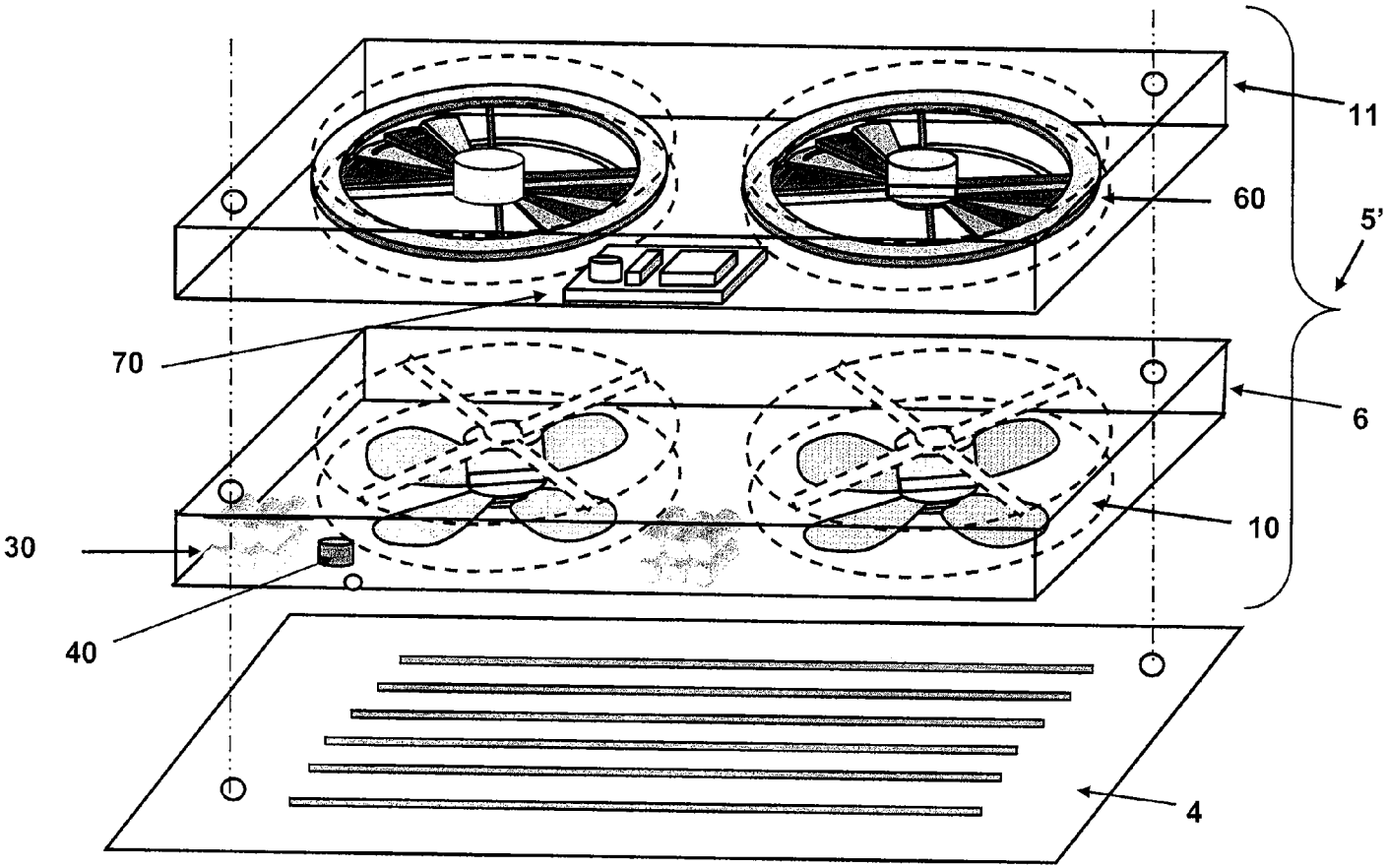
FIG. 12 shows a 3-D exploded perspective view illustrating a method of installing the present invention on a register grill.

A third method of installation is illustrated in FIG. 12. Flow control device 5' is affixed to register grill 4. Flow control device 5' has all the same components as the duct version, arranged in a different geometry. Grill mounting bracket 6 is affixed to the interior side of register grill 4. One or more parallel rotating structures 10 are mounted side by side into grill mounting bracket 6, effectively covering the vent area of register grill 4. Power storage device 30 is placed within grill mounting bracket 6. Restriction member bracket 11 is affixed to grill mounting bracket 6. One or more restriction members 60 are mounted side by side into petal valve bracket 11 such that the restriction members 60 are axially oriented coincident to rotating structures 10.

FIGS. 13, 14, and 15 illustrate one embodiment of sensor module 8'. FIG. 13 illustrates a side view of sensor module 8' and FIG. 14 is the front view. Sensor module 8' in this embodiment is designed to be installed in a standard AC outlet. FIG. 15 shows the specific internal workings of sensor module 8' embodiment. In this embodiment, sensor communications device 44 includes an infra-red LED 442, driven by driver 443. Driver 443 is controlled by sensor microcontroller 51. Sensor microcontroller 51 is connected to an AC line which serves as power source 38 by way of power regulator 37. Sensor microcontroller 51 receives user input from user preference sensor 46 shown here as a standard rotary dial.

Figure 17:
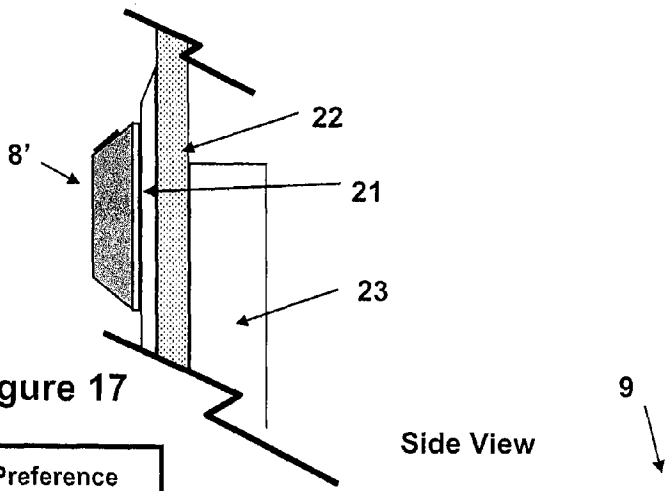
FIG. 17 shows a side view illustrating an inductive coupled AC powered sensor module.
Figure 16:
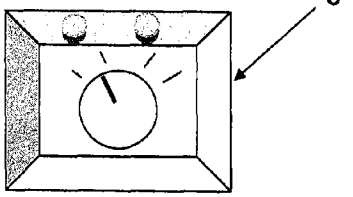
FIG. 16 shows a front view illustrating an inductive coupled AC powered sensor module.
Figure 18:
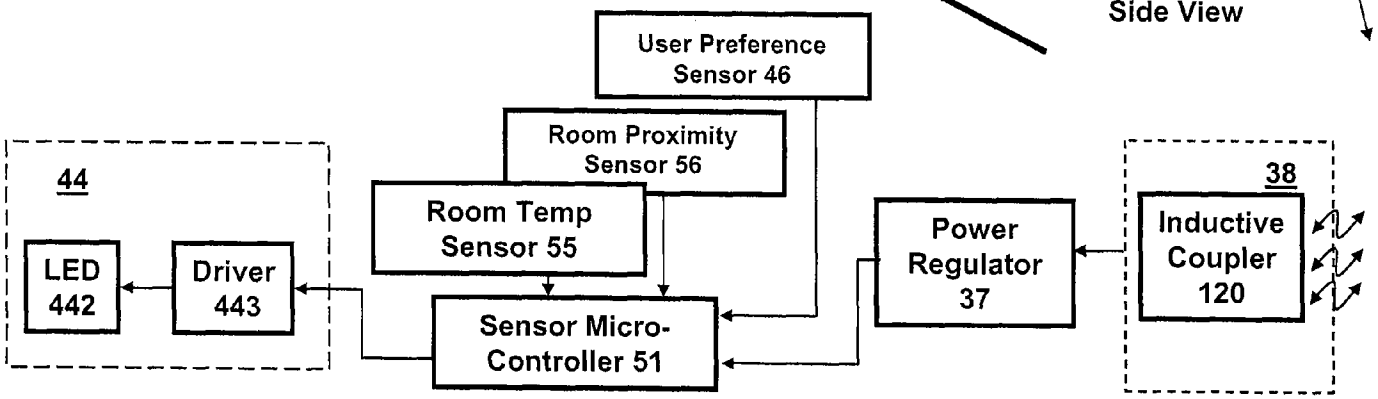
FIG. 18 shows a schematic view illustrating an inductive coupled AC powered sensor module.

FIGS. 16, 17, and 18 illustrate another embodiment of sensor module 8'. FIG. 16 illustrates a front view of sensor 8' and FIG. 17 is a side view showing sensor 8' affixed to a switch plate 21 on wall 22 adjacent to electrical box 23. Such a configuration is typical of a standard wall mounted light switch. FIG. 18 shows the specific internal workings of sensor 8' embodiment. In this embodiment, an inductive coupling 120 serves as power source 38. Inductive coupler 120 may be any of a number of devices capable of exchanging electrical energy by inductive means. This allows sensor 8' to provide all the capabilities of the embodiment discussed in FIG. 15. Additionally this embodiment has a room proximity sensor 56 connected to sensor microcontroller 51 allowing for changes in performance based on the presence of people in the room.

Figure 19:
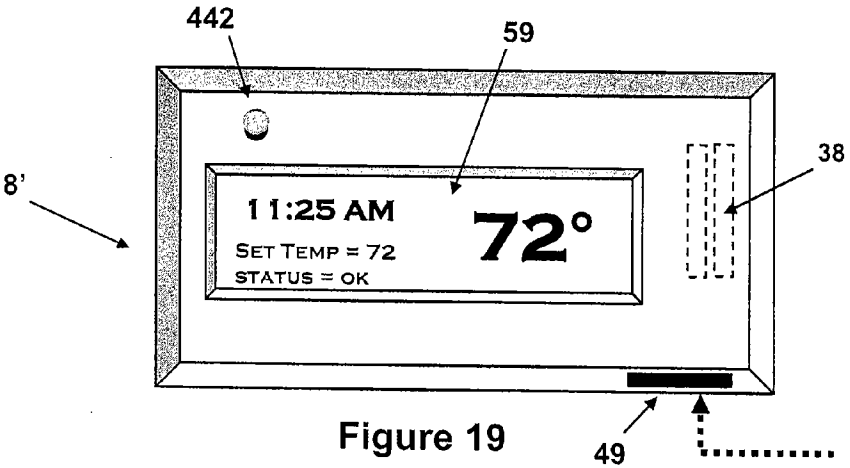
FIG. 19 shows a battery powered remote programmable sensor module.
Figure 20:
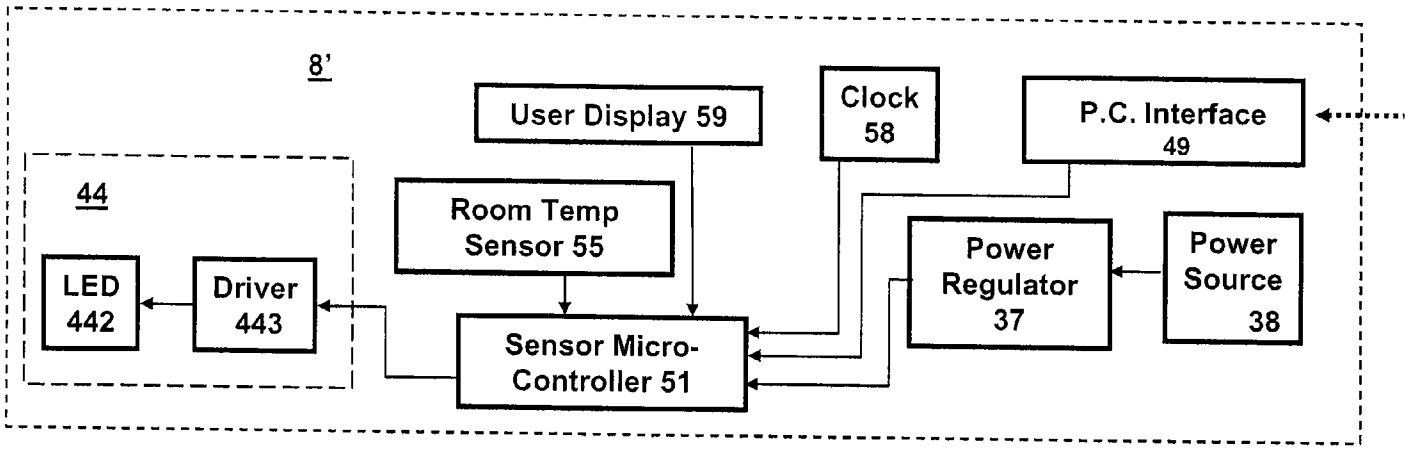
FIG. 20 shows the schematic of a remote programmable sensor module.

FIGS. 19 and 20 show a more advanced embodiment of sensor 8'. FIG. 19 shows a face view of the sensor 8' as it might be seen in a wall mount configuration. FIG. 20 shows the internal schematic for this embodiment. As before, the sensor microcontroller 51 is connected to a room temperature sensor and relays data by way of driver 443 and LED 442 and power for the microcontroller is provided by power regulator 37 and power source 38. However in this implementation, the sensor 8' may receive remote user preferences and instruction from P.C. interface 49 which is connected to sensor microcontroller 51. Because these more complex user requests may require knowledge of time of day, sensor microcontroller 51 is connected to clock 58. In order to relate status to the user, the sensor microcontroller 51 is also connected to a user display 59 capable of displaying such information as may be appropriate for a particular implementation.

Figure 21:
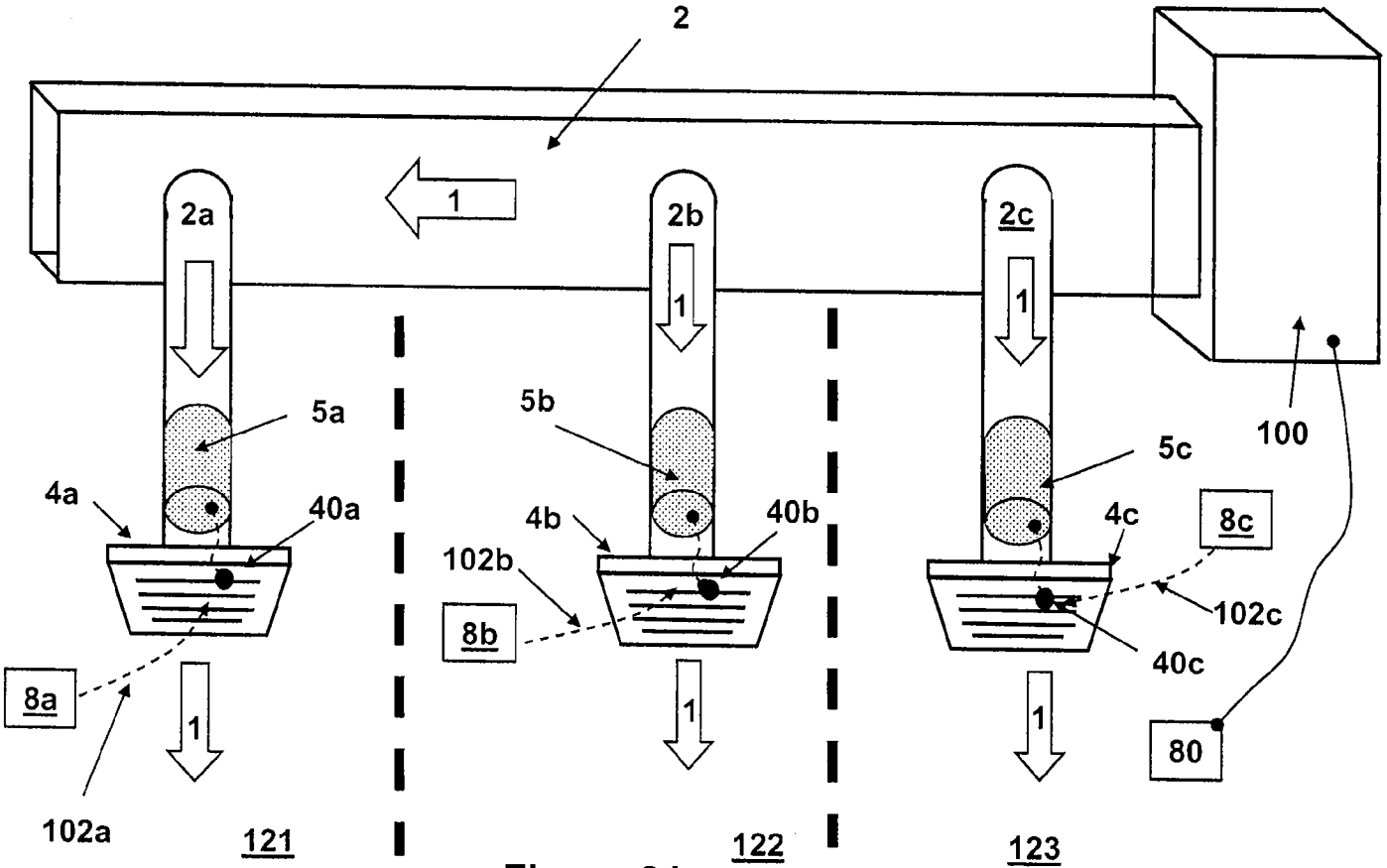
FIG. 21 shows a diagrammatic view illustrating operation of a plurality of flow control devices with an environmental control unit in the on state.
Figure 22:
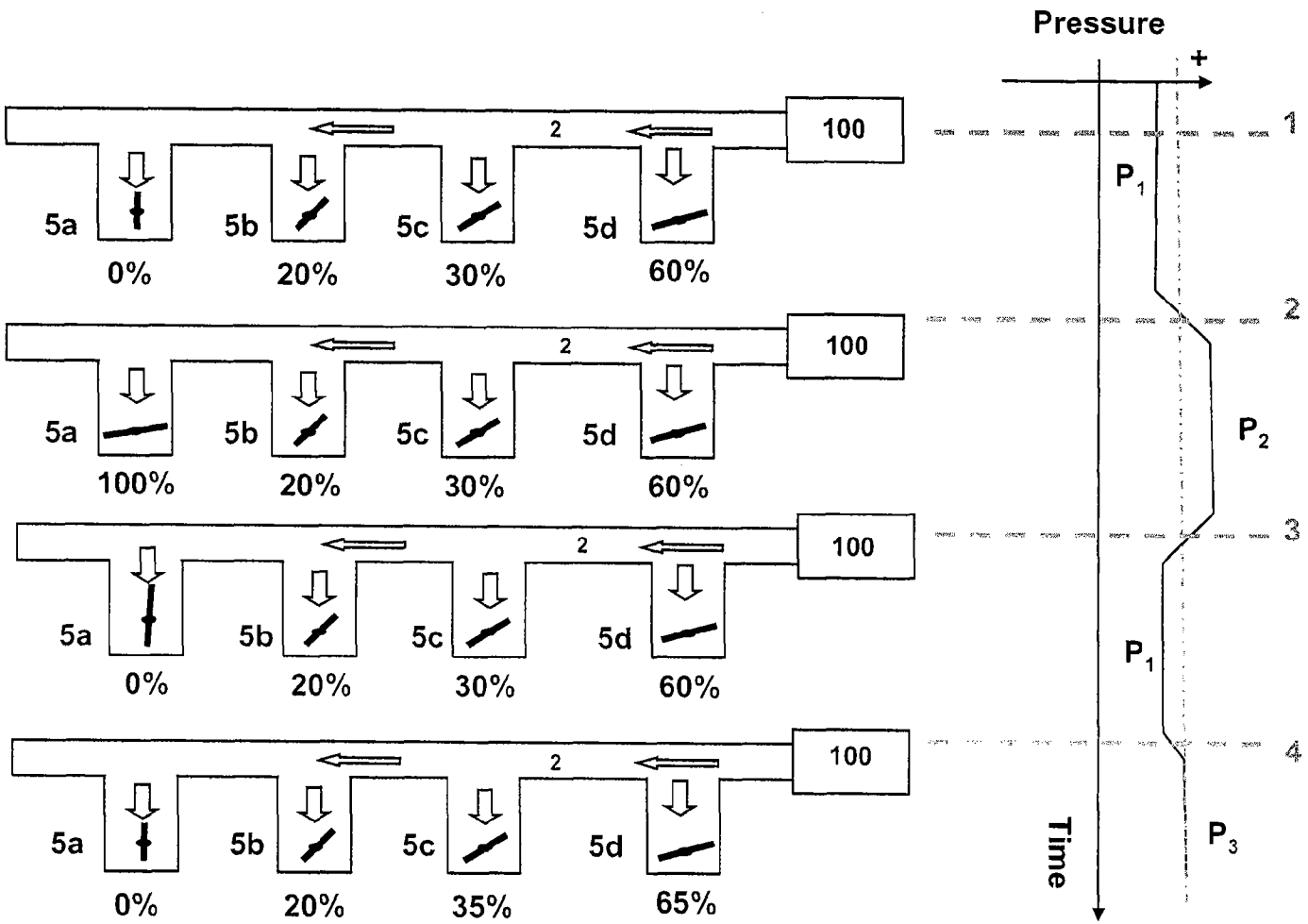
FIG. 22 shows a method of signaling between flow control units.

FIG. 21 illustrates an example of the operation of a plurality of flow control devices 5*a*, 5*b*, 5*c* in operation while environmental control unit 100 is in the on state. FIG. 22 illustrates the operation as step by step operations as seen executed by a single flow control device 5 as shown in FIG. 21. Each flow control device 5*a*, 5*b*, 5*c* receives its respective data stream 102*a*, 102*b*, 102*c* from their respective sensors 8*a*, 8*b*, 8*c* representing the local environmental conditions of their respective rooms 121, 122, 123. In this example, if a user in room 121 desires a different environmental condition, such as temperature, than a user in either room 122 or room 123 then the airflow is changed. In order to accomplish this goal, different amounts of airflow need to be delivered to the respective rooms differing from that which would normally have been delivered by environmental control unit 100 through ductwork 2.

In this example of operation, respective user preferences have been programmed directly into flow control devices 5*a*, 5*b*, 5*c*. Central controller 80 signals environmental control unit 100 to transition to the on state, step 220 of FIG. 23. Environmental control unit 100 causes airflow 1 to flow through ductwork 2, 2*a*, 2*b*, and 2*c* and into flow control devices 5*a*, 5*b*, and 5*c*. In room 121, airflow 1 causes rotating structure 10 (shown in FIG. 4) of flow control device 5*a* to rotate, step 221, causing generation of electrical energy by motor-dynamo 31 (shown in FIG. 4) which is detected by the microcontroller 50, step 222, by way of analog to digital converter 52 and motor-dynamo bus 33. Microcontroller 50 next checks to see if this is the first time the device has been in the system, step 223. If true, microcontroller 50 loads factor preset information from read only memory into the active operational memory step 224. If false, microcontroller 50 loads the most recent operational data from non-volatile storage into the active operational memory, step 225. The operational data used by a system may include: recent restriction position, upstream pressure, airflow during last cycle, rate of change of the room temperature as a function of time and airflow, recent requests for cooperation, max upstream pressure permitted, battery charge at end of prior cycle, length of recent HVAC cycles, and various user flags representing the user preferences for operation. Once the system is initialized, the microcontroller 50 pauses to allow the airflow to stabilize and then checks to see if the HVAC unit is in cooling or heating mode. Although the system operates in a similar mode in both heating and cooling modes, certain operating parameters and functions may be changed to create better performance in the specific modes, step 226.

The individual microcontrollers 50 now begin to monitor and adjust the performance of the flow control device 5*a, b, c* in step 227. The details of operations in step 227 are shown in FIG. 24. The microcontroller 50 reads the room temperature transmitted from sensor 8, step 241. After acquiring the room temperature the microcontroller 50 updates its knowledge of the local operating conditions such as: upstream pressure, airflow, rate of change of the room temperature as a function of time and airflow, battery charge, and checks various user flags for preference changes, step 242. Using this information the microcontroller 50 calculates the time that will be necessary to reach the user preference goal in the room, step 243. Based on this calculation, the microcontroller 50 makes a determination as to whether the time is shorter than the expected cycle length or longer, step 244. If the time is longer than the expected cycle, the flow control device 5 needs to reduce its restriction to allow more air to flow. In this event, the microcontroller looks to see if it is currently cooperating with other units, step 245, and, if not, the microcontroller opens the restriction by a percentage, step 246, allowing more air to pass into the room and accelerate the time to reach the user preference goal. These percentages can be fixed, calculated, or adaptively determined during the operational life of the device. In the event cooperation mode is in effect, the change in restriction may be reduced or blocked and the subroutine ends. In the event the time estimate is shorter than the anticipated cycle, assuming the battery is sufficiently charged, step 247, and the pressure limit of the HVAC system will not be exceeded, step 248, the microcontroller 50 can restrict the flow of air and retard the rate of heating or cooling in the room, and make more air available to others in the system, step 249. As before, the percentage reduction can be fixed, calculated, or adaptively determined from experience over the operational life of the device. At the completion of adjustment to the flow control device 5, if it was required, the microcontroller 50 returns to the main process as shown in FIG. 23.

There are other conditions which the microcontroller 50 must detect and respond to and these are shown in steps 228, 229, 230. In the course of operation a situation may arise where a specific flow control device 5*a* will not make its goal even if it opens full wide to zero restriction. A solution to this situation can be engineered if the other flow control devices 5*b,c* retard the airflow in their respective zones thereby increasing the upstream pressure and providing more air into ductwork 2*a*. In order to facilitate this type of cooperation among autonomous units, a signaling method can be employed to flag the need for cooperation among the flow control units, i.e., a specific flow control device 5 could broadcast a request for help. Signaling between flow control devices 5 can be implemented by using the restriction member 60 and rotating structure 10 as signaling devices. The use of these components to generate a signal is depicted in FIG. 22. At time step one, four flow control units 5*a, b, c, d* are operating a set at restrictions of 0%, 20%, 30%, and 60% respectively. Flow control device 5*a* which is already operating at 0% restriction has no further capacity to increase airflow in his served room. In the event flow control unit 5*a* detects that it will not reach its user requested preference, it signals a need for help to the remaining units in the structure by momentarily closing and then opening its restriction device. This has the effect of creating a momentary rise in pressure in ductworks 2. This pressure rise is depicted between time steps 2 and 3 in FIG. 22. The pressure pulse ends when flow control device 5*a* returns to its full open position.

An alternate method of signaling could be enabled through the use of an acoustic tone transceiver 66 in each unit as shown in FIG. 9.

Figure 23:
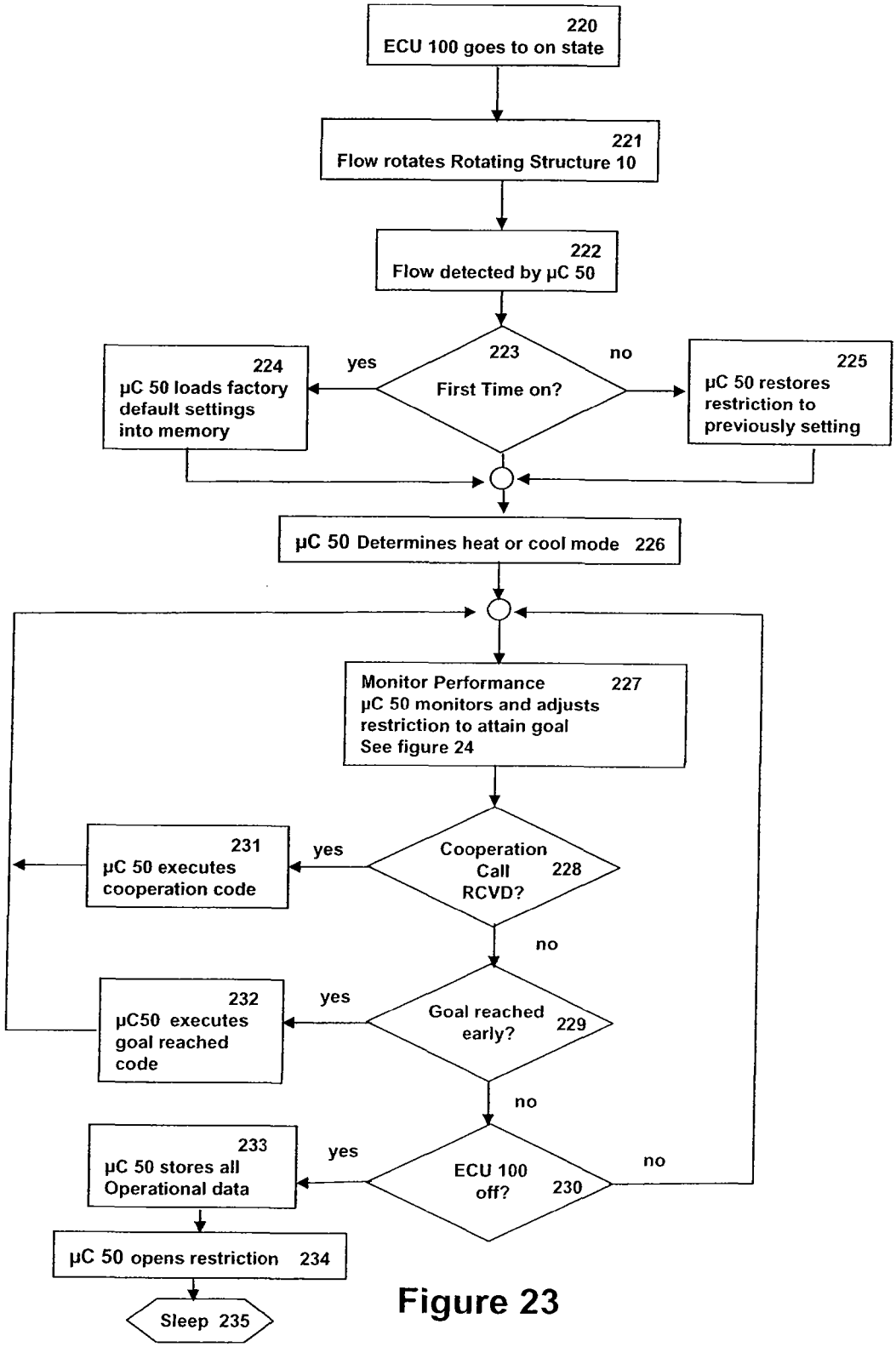
FIG. 23 is a flow chart of method steps illustrating the operation of the present invention.
Figure 24:
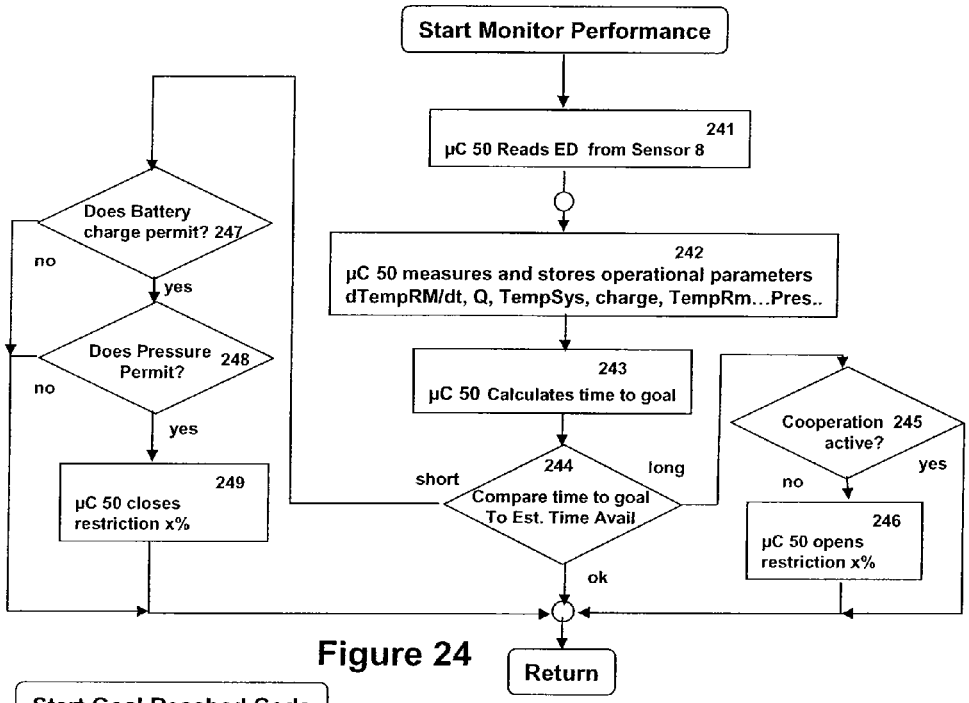
FIG. 24 is a flow chart of method steps for monitoring and control operations.
Figure 26:
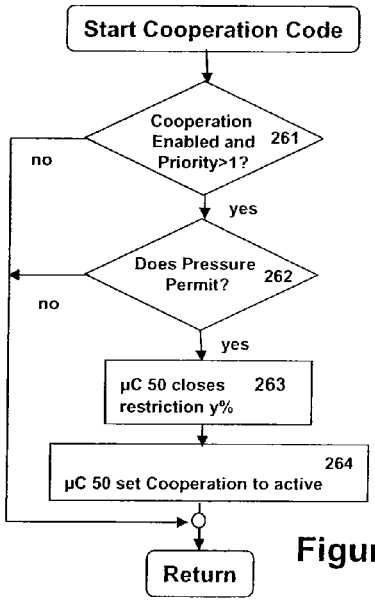
FIG. 26 is a flow chart of method steps describing the cooperation between flow control units.

When microcontroller 50 detects a request for cooperation from other flow control units 5 in the structure it executes a code to enable cooperation, FIG. 23, step 231. The details of a possible implementation are shown in FIG. 26. First the microcontroller 50 checks to see if cooperation has been enabled by the user in the user preferences, step 261. If cooperation is not enabled, equivalent to giving highest priority to a specific room, the microcontroller ignores the request and returns to the master process. In the event that the preference has been set for cooperation, then the microcontroller 50 checks to see if the upstream pressure will allow for additional restriction, step 262. If no, the microcontroller 50 ignores the request and returns to the main process. If both tests are positive the microcontroller 50 closes its restriction member 60 by a percentage step 263. This percentage can be fixed, calculated, or adaptively determined during the operational life of the device. The effect of this restriction can be seen in FIG. 22, at time step 264 where flow control devices 5*c* and 5*d* have both responded, increasing the duct 2 pressure to $P_3$. As a final step, the microcontroller sets a flag in the operational memory to signify cooperation is active which restricts future restriction within the specific flow control device 5, step 264, FIG. 26. This flag can be set to expire in a time period or at the end of a cycle to maintain the dynamic ability of the collective system. Additionally levels of priority can be established to establish a range of cooperation (or restriction) that a given device may volunteer.

Figure 25:
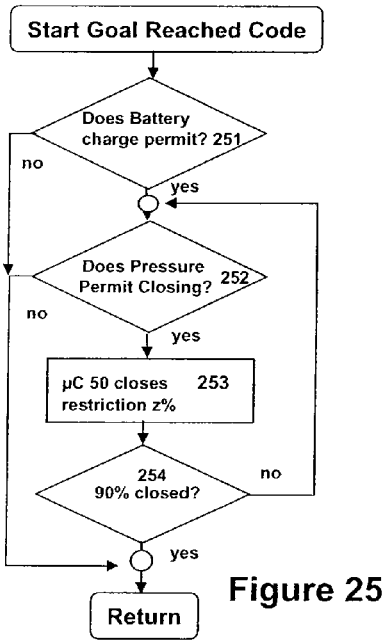
FIG. 25 is a flow chart of method steps for controlling actions in the event a goal is reached.

Another condition the microcontroller 50 must detect is the reaching of the user preference goal earlier than at the end of the cycle to prevent over cooling or heating in the specific room. Microcontroller 50 makes this determination by comparing the user set preference with sensor 8 data FIG. 23, step 232. If the condition exists, microcontroller 50 executes the goal reached code shown in FIG. 25. The goal reached code first checks the state of the power storage device 30, step 251. If the power storage device 30 is sufficiently charged, the microcontroller 50 goes on to check if the upstream pressure in duct 2 can tolerate further restriction without damaging the system, step 252. Microcontroller 50 can access the pressure limit by either look up within preprogrammed limits, or alternatively can monitor the slope of the airflow pressure curve to detect when the system begins to operate outside the recommended pressure. If both the power storage device 30 and the upstream pressure permits, the microcontroller 50 begins a loop to substantially close the flow control unit's 5 restriction member 60, FIG. 25, step 253 and step 254. At the completion of the routine, the microcontroller returns to the main process.

At the end of the main process loop, FIG. 23, microcontroller 50 checks to see if the environmental control unit 100 has transitioned to the off state, step 230. If true, the microcontroller 50 calculates the length of time the environmental control unit 100 was on, writes this, and all of the other operational data from the memory into non-volatile memory to preserve it until the next duty cycle, step 233. After storing the data, microcontroller 50 opens the flow control units 5 restriction device to a substantially open position, step 234. This is done to both enable the detection of the next start of the cycle, as well as a fail safe in the event the system may not be started for a great period of time and the power storage device 30 may have become fully discharged. By substantially opening the restriction member 60, the rotating structure 10 will have maximum charging potential on restart. In the final step 235, the microcontroller 50 enters a sleep mode to preserve energy and reduce drain on the power storage device 30.

Eventually, the microcontroller will be awakened by an interrupt control tied to the generation of energy by the rotating structure by steps 220 and 221, and the main process begins again.

There are numerous alternative methods that can be used to perform calculations to govern the actions of a flow control unit 5. For example, program instructions could use the actual temperature, requested temperature, and flow restriction device temperature to determine whether to invoke a means to restrict flow. Two conditions may exist. In the first condition, if the actual temperature is greater than the requested temperature and the flow restriction device temperature is less than the actual temperature, or the actual temperature is less than the requested temperature and the flow restriction device temperature is greater than the actual temperature, then microcontroller 50 calculates the amount of flow restriction to invoke. This amount of flow restriction to invoke may be zero to maximum possible flow restriction and could be calculated from an inverse linear relationship between the difference between the actual temperature and the requested temperature ($\Delta T$). More complex calculations can be implemented. For example, piecewise linear equations, linear optimization techniques, or continuous functions may be applied.

In the second condition, if the actual temperature is less than or equal to the requested temperature or the flow restriction device temperature is greater than or equal to the actual temperature and the actual temperature is greater than or equal to the requested temperature or the flow restriction device temperature is less than or equal to the actual temperature, then microcontroller 50 sets the amount of flow restriction to invoke to the maximum possible flow restriction. In this example, these same program instructions apply without regard to whether environmental control unit 100 is heating or cooling.

Referring back to FIG. 4, microcontroller 50 signals flow restriction control 62, which actuates stepper motor 64. Stepper motor 64 closes restriction member 60. Additional flow restriction means may be provided by the rotating structure. For example, microcontroller 50 may signal load control 36 to extract electrical energy from motor-dynamo bus 33, which in turn causes motor-dynamo 31 to use rotating structure 10 to extract electrical energy from the kinetic energy of the airflow. The extraction of electrical energy from the kinetic energy causes a reduced flow to the room. Load control 36 absorbs the collected electrical energy, typically by using a resistive load.

In the event microcontroller 50 detects depletion of power storage device 30 by way of power bus 39 and analog to digital converter 52, then microcontroller 50 invokes means to replenish power by signaling power manager 35 to draw electrical energy from motor-dynamo bus 33, which in turn causes motor-dynamo 31 to use rotating structure 10 to extract electrical energy from the kinetic energy of the airflow. Power manager 35, in turn, deposits the electrical energy to power storage device 30. The extraction of electrical energy from the kinetic energy also causes reduced flow to the room. Typically, replenishment of power storage device 30 has precedence over the amount of flow restriction to invoke.

The present invention eliminates the need for a central controller or central processing unit to achieve overall environmental control goals. When one or more flow control devices 5 fail, they fail to renew their requests for cooperation and the remaining unit continues to cooperate and optimize individual and overall environmental goals.

In a similar failure situation, a signaling means between flow control devices may partially or totally fail, resulting in requests for cooperation from those flow control devices that are affected. The functional flow control devices still continue to operate independently or partially independently towards achieving the overall environmental control goals. Flow restriction decisions will be made from locally derived information available. If necessary, a single functioning flow control device may continue to operate to meet environmental control goals for the room it serves. Therefore, the present invention is not subject to the risk complete system failure caused by a failed central controller, central processing unit, or failed signaling systems.

Operational data used by the microcontroller and maintained in memory includes the parameters necessary to execute the previously described embodiments, such as temperature, requested temperature, and flow restriction device temperature. Operational data image also includes parameters which enable more advanced adaptive program instructions. For example, by tracking whether a given room reaches its goal during an on state cycle of the environmental control unit, the parameters associated with the inverse linear relationship between the difference between the actual temperature and the requested temperature ($\Delta T$) and the amount of flow restriction can be adjusted.

In another example, in order to protect the environmental control unit from damage due to excessive restriction of flow, the duct air pressure upstream of the flow control device may be estimated knowing the temperature and the rotation rate of the rotating structure as deduced from the potential voltage presented by motor-dynamo upon the motor-dynamo bus. Each flow control device may sense duct air pressures and adapt its flow restriction in accordance with duct air pressure limits if hardwired or calculate acceptable ranges of operation by constructing an airflow vs. pressure data set and holding Δ(airflow)/Δpressure within the target linear portions of the operating curve. Alternatively, data regarding duct pressure may be provided by a duct pressure sensor 69 as depicted in FIG. 9.

Figure 27:
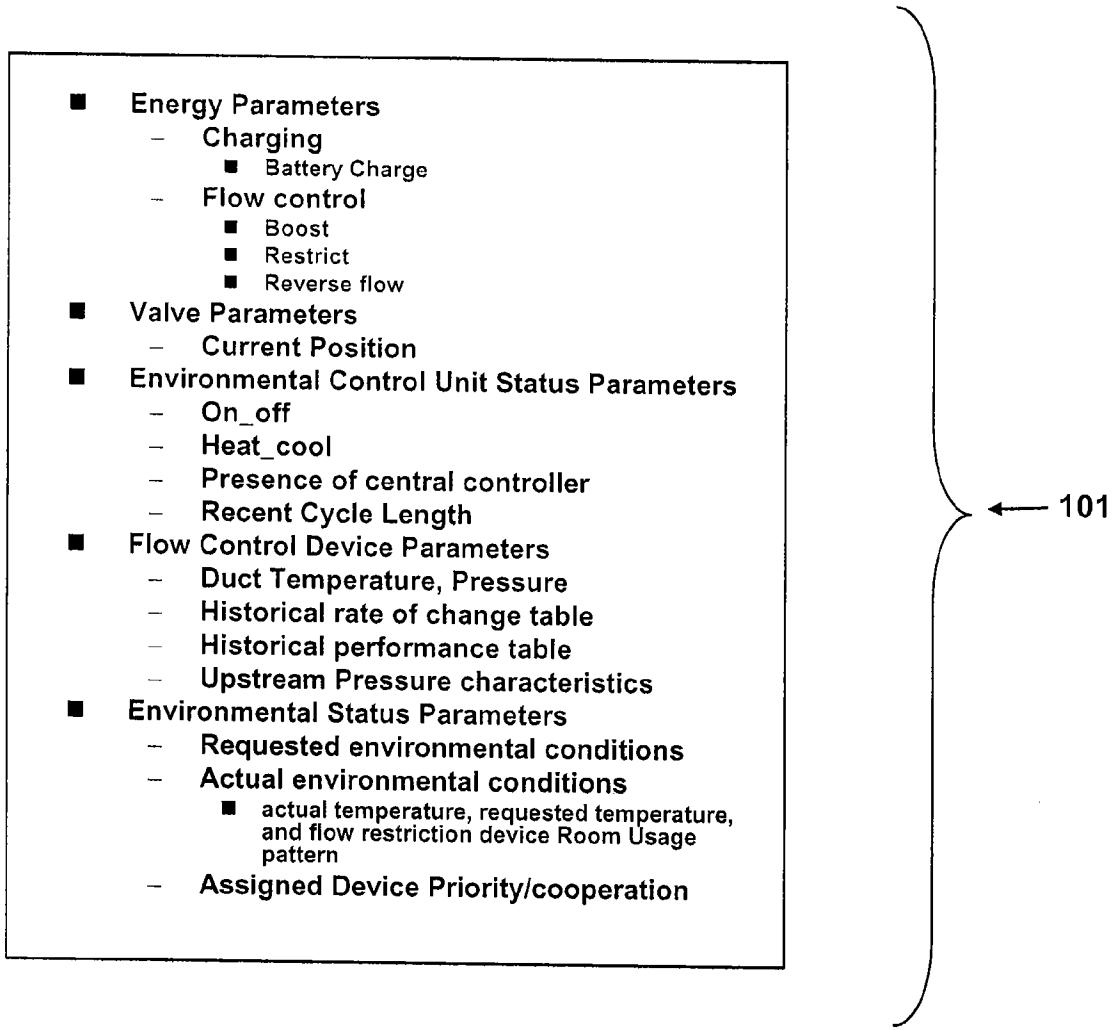
FIG. 27 shows a tabular view of operational data image.

FIG. 27 illustrates a typical embodiment of the operational data held in memory. The operational data memory may be organized as a set of objects and may include a variety of data elements, which may also be called parameters. Classes of parameters include Energy parameters, Valve parameters, Environmental Control Unit Status Parameters, Flow Control Device Parameters, and Environmental Status Parameters.

Energy Parameters relate to the status of rotating structure 10 and the energy state of flow control device 5. The microcontroller of the flow control device adapts the program instructions to account for the values of these parameters. Examples of energy parameters include: charging, battery charge, and flow control. The charging parameter is a flag that the rotating structure is currently supplying power to recharge the battery. If the flag is set, then this signals that the flow control device will be limited in its ability to restrict flow. Maintaining power source charge is almost always given precedence over other functions of the rotating structure in instances where a battery is used for the power source. The battery charge parameter is a numeric value which represents the current charge level of the power source. This allows the various systems to estimate the time remaining to a full charge, at which time more restriction will be available to the system. In the event a wired source is used for the power source, battery charge is set to maximum. The 'flow control' parameter is a multi-valued parameter which describes the current use of the rotating structures in the flow control device for activities other than charging and the magnitude of those activities. In the event of multiple rotating structures, the variables have indexes which allow the program instructions to access the values sequentially, i.e. Rotation (1), Rotation (2). Rotation (n)=(x, magnitude) where n is the index to the specific structure and x is a numeric flag where:

1=Boost mode

2=Restriction mode

3=Reverse flow mode

Valve Parameters relate to the status of any passive restriction used in the flow control device. An example of a valve parameter is the 'current position' parameter. In the event the flow control device is equipped with a petal valve or other passive flow restriction device, the 'current position' parameter represents the current amount of restriction which is being provided. In many embodiments this variable is calibrated to actual flow restriction percentage. Flow control devices assess the full system response of their individual and collective actions based on the value of the 'current position' and the 'flow control' parameter.

Environmental Control Unit Status Parameters relate to the status of any environmental control units in the system. Examples of Environmental Control Unit Status Parameters include: On_off, Heat_cool_dry, 'presence of central controller', and 'recent cycle length'. The On_off parameter is a flag which represent the current state of the environmental control unit. The flow control unit switches operation instructions based on the value of this flag. The Heat_cool_dry parameter is a multi-value flag which represents the current mode of the environmental control unit. In most installations this flag represents whether the environmental control unit is supplying air which is warmer, cooler, wetter, or drier than the room being serviced. In certain operating scenarios, flow control units alter their actions based on the value of this flag. The flag is set by the flow control device by comparing the values of its internal sensors and the corresponding sensor 8 in the room being serviced. The 'presence of central controller' parameter is a single value flag which is used to alert the flow control devices in the installation of which room or rooms have central controllers. This enables such rooms to be treated differently. In one embodiment for example, rooms which have the central controller will purposely delay satisfying their user environmental preference to allow other rooms in the system time to reach their goals. In another example, in the case where the environmental unit is in the "off" state, flow control devices push air back through the duct system towards the central controller using the value of this flag as set forth herein. The 'recent cycle length' parameter contains the length of time that the environmental control unit remained in the "on" state during the last several "on" states. The flow control devices use this parameter to predict the total available air conditioning that may be provided during the next "on" state in order to improve flow restriction performance.

Flow Control Device Parameters relate to internal measurements and calculations taken by the flow control device. Examples of Flow Control Device Parameters include: type of device, duct temperature, duct pressure, historical rate of change table, and historical performance table. The type of device parameter is a multi-valued parameter which represents the type and capabilities of a specific flow control device. This may include the version or model number of the physical device, the version number of the program instructions, and the adaptive code mode being used. A flow control device may have one or more types of restriction devices or rotating structures which are represented by the values of this parameter. Flow control devices calculate the range of possible responses to a given situation by using this flag. The duct temperature and duct pressure is a dual-valued parameter which contains the current temperature in the flow control device and the upstream pressure in the ductwork. The flow control device estimates the upstream pressure using a measured energy output of the rotational structure by way of the motor-dynamo, motor-dynamo bus, and analog to digital converter, and the air temperature to correct for density effects. This parameter is important in preventing the collective group of flow control devices from overly restricting flow in the ductwork and causing damage to the environmental control unit. The historical rate of change table is an object which is used to store parameters relating to how rapidly the environmental changes occurred in the room due to operating parameters of the flow control device. The program instructions use this data to adapt the operating strategy for the device in a specific room. This provides a means for devices to sense the relative differences in the rooms serviced and adjust operating parameters appropriately. The historical performance table is an object which is used to store parameters relating to how well the flow control device was able to satisfy past user environmental requests. Using knowledge of past performance, the flow control device alters its program instructions. This object captures changes in heat sources and sinks in a given room such as the effect of afternoon sun. Although a given flow control device may have had no problem reaching user environmental requests in the morning, the added influx of heat will cause the flow control device to lag in the afternoon and the program instructions detect this change through this object and response accordingly.

Environmental Status Parameters relate to data received from sensor 8. Examples of Environmental Status Parameters include: requested environmental conditions, actual environmental conditions, and assigned device priority. The requested environmental conditions parameter contains the requested environmental parameters set by the user. This is used by the flow control devices as a primary input to determine operating parameters using program instructions. An example is the requested temperature. The actual environmental conditions parameter contains various readings as measured by sensor 8, for example data gathered from room temperature sensor 55, room proximity sensor 56 or room humidity sensor 57. Using program instructions, the flow control device compares this parameter to the requested environmental conditions to determine action. The assigned device priority or cooperation parameter captures the user's planned use of a given room and its interaction with other units in the structure. The flow control device selects the appropriate action using this variable. In a typical embodiment this parameter might have values such as:

1=Heavy use room, do not cooperate

2=Occasional use room, cooperate

3=Timed use room, cooperate during specific times of the day

4=Unused room

Figure 28:
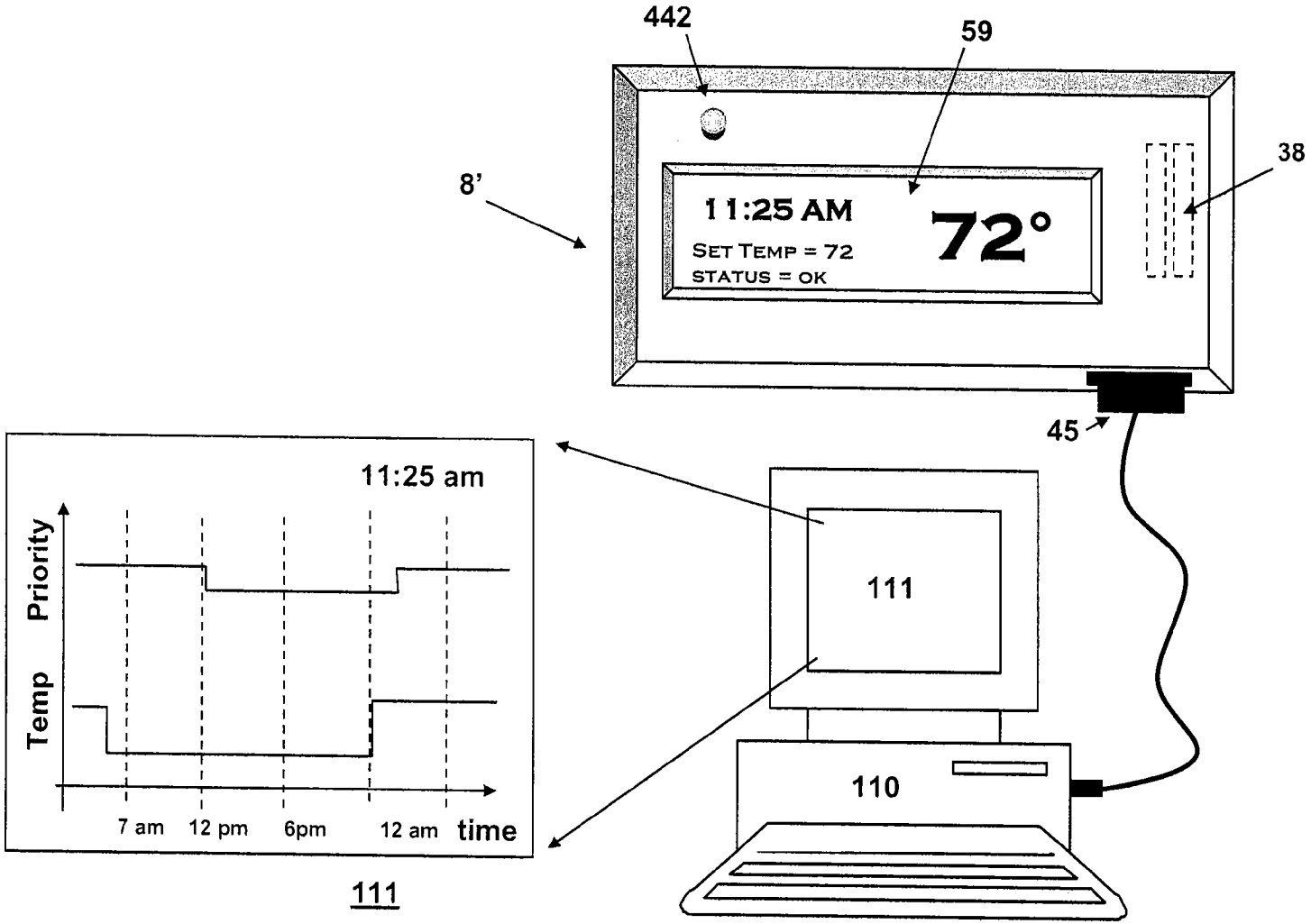
FIG. 28 shows a method of a remote programming sensor using a personal computer.

In any particular installation, users have different needs for the various rooms. This can be expressed as a cooperation or priority parameter. For example, a room may be unused for a period of time. A user may allow cooperation from those rooms which are not in use to allow greater operating latitude to those flow control devices which are serving these other rooms which are in use. Alternatively, a proximity sensor detects the use or non use of the room which may be used by the program instructions to appropriately control the cooperation for that room. In yet another embodiment, the user may express his preference for cooperation or priority, or environmental parameters within specific times of the day, for example one might raise the set temperature and increase the priority of bedrooms during the day time when the rooms are unused, returning to a lower set temperature and higher priority in time for occupation at bedtime. Such an application can be enabled as shown in FIG. 28. The room sensor 8' is connected to a personal computer 110 for programming. The user may set the various parameters along a timeline, viewing the results on P.C. display unit 111. On completion of programming the sensor 8' is disconnected from personal computer 110 and returned to service in the room to be controlled.

In the preceding embodiments, flow control devices restricts airflow. In an alternative embodiment, rotating structure 10 is operated in such a manner as to boost the airflow through the flow control device. Microcontroller 50 signals power manager 35 to transfer electrical energy from power bus 39 to motor-dynamo bus 33, causing rotating structure 10 to accelerate propulsion of air into the room. Program instructions may account for boost capability by treating boost capability as a negative amount of flow restriction.

Figure 29:
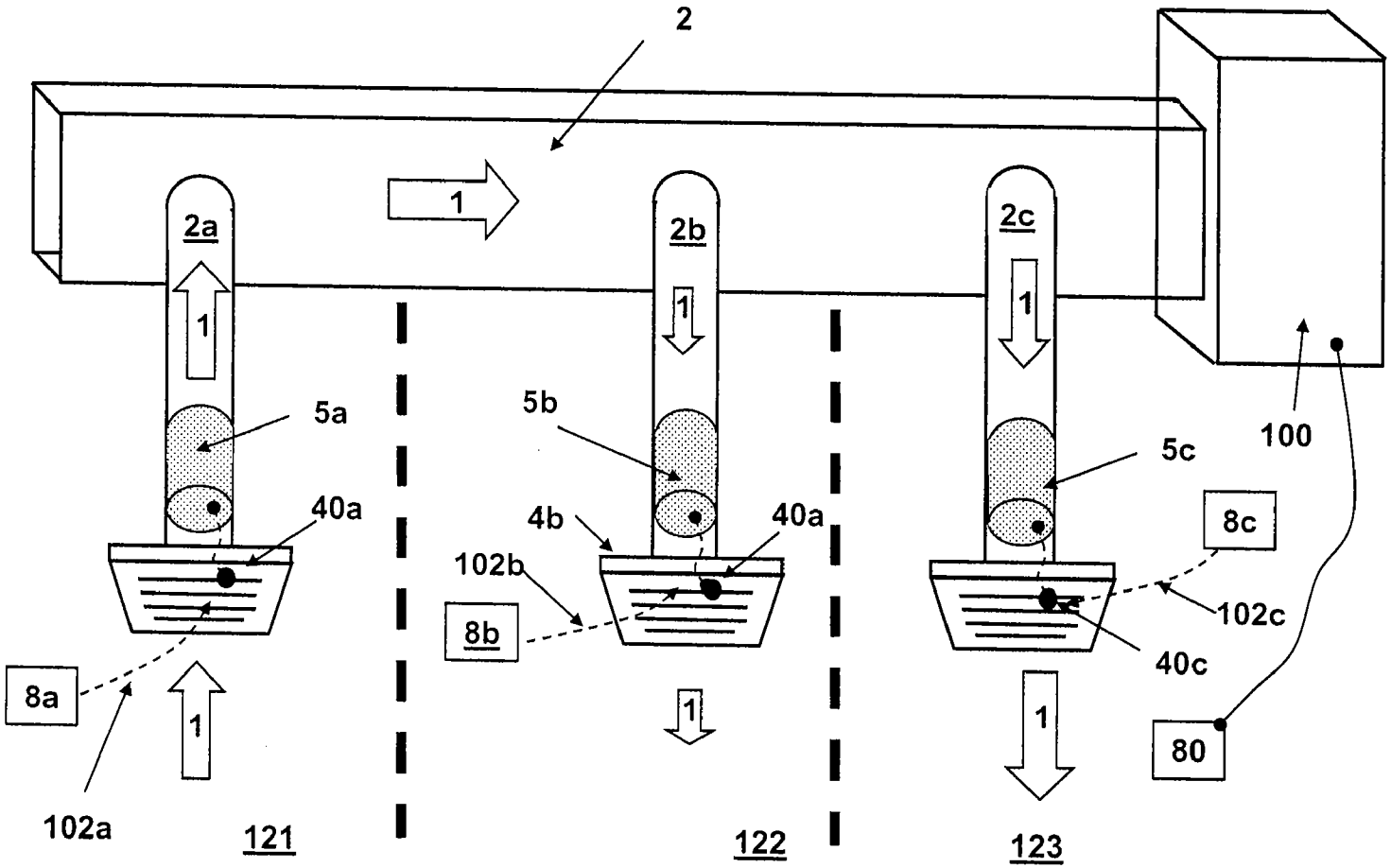
FIG. 29 shows a diagrammatic view illustrating operation of a plurality of flow control devices with an environmental control unit in the off state.

In another embodiment, the flow control devices operate during periods when the environmental control unit is in the "off" state. Referring to FIG. 29, in this example of operation, room 121 is not at the desired environmental condition while at the same time room 123 is at its desired environmental condition. Central controller 80 does not signal environmental control unit 100 to transition to the "on" state. Flow control device 5*a* serving room 121 activates rotating structure 10 in the reverse direction, thereby reverse flowing air through ducts 2 and 2*a*. Airflow 1 exhaust into duct 2*c*, entering room 123 and altering the environmental condition of room 123. In the case of room 121 being too hot, the withdrawal of air from room 121 serves to cause cooler air from other locations to enter room 121. Additionally, air from duct 2 which is typically too hot enters room 123 causing the environmental condition of room 123 to no longer be at its desired environmental condition. Central controller 80 thereby signals environmental control unit 100 to transition to the on state.

Flow control device 5*a* in room 122 detects airflow caused by the operation of flow control device 5*a*. By determining the temperature of the incoming air with respect to its goal, flow control device 5*a* joins in by restricting or even reversing airflow. Flow control device 5*c* in room 123 also detects airflow caused by the operation of flow control devices 5*a* and 5*b*. By determining the temperature of the incoming air with respect to its goal and knowing it services the room containing the central control 80, flow control device 5*c* may join in by boosting flow into room 123. In this way, the flow control devices act cooperatively to cause central controller 80 to signal environmental control unit 100 to the "on" state.

The key to the ability to cooperate in the present invention is enabled by the several independent devices' ability to signal each other when certain events, such as not making the user's functional request occur, allowing the group to alter operational parameters to cooperate. In the previous examples, the ability to signal asynchronously between the units existed. In another embodiment, all the units could be made to operate synchronously. This could be enabled by installing a simple ultrasonic or acoustic tone transceiver 66 in each flow control unit 5 capable of sending and detecting a tone or complex series of tones within the ductworks 2 as shown in FIG. 9. In one embodiment, one unit could be given master status, issuing periodic sync tones. On receipt of tone, all units currently experiencing a heating or cooling deficit could move their restriction members 60 to the full closed position. By measuring the upstream pressure during this restriction period, the flow control devices could calculate the number of independent zones in need of boost and modify their behavior accordingly. The presence of an acoustic or ultrasonic transceiver could also enable additional asynchronous modes. In one such embodiment, each independent unit could have a unique identifier, and could be enabled to broadcast a signal within the ductworks 2 representative of its status or needs to the other devices.

FIG. 9 also illustrates the additional subsystems which might be included to make the flow control device 5 independent of sensor 8. The functions of sensor 8 are replaced by remote environmental sensor 68 which is capable of determining the environmental parameter in the room serviced from a position on the register grill. The remote environmental sensor 68 is connected to the microcontroller 50 by way of remote environmental sensor interface 67. Additionally, to give microcontroller 50 the information to manage complex user preference requests which are variable with time of day, microcontroller 50 is connected to clock 58'. Complex instructions and correct time can be up loaded to the flow control unit 5 by way of either communications device 40 or P.C. interface 45'. Independence from sensor 8 opens certain applications that may be functionally preferred or economically more practical.

Figure 30:
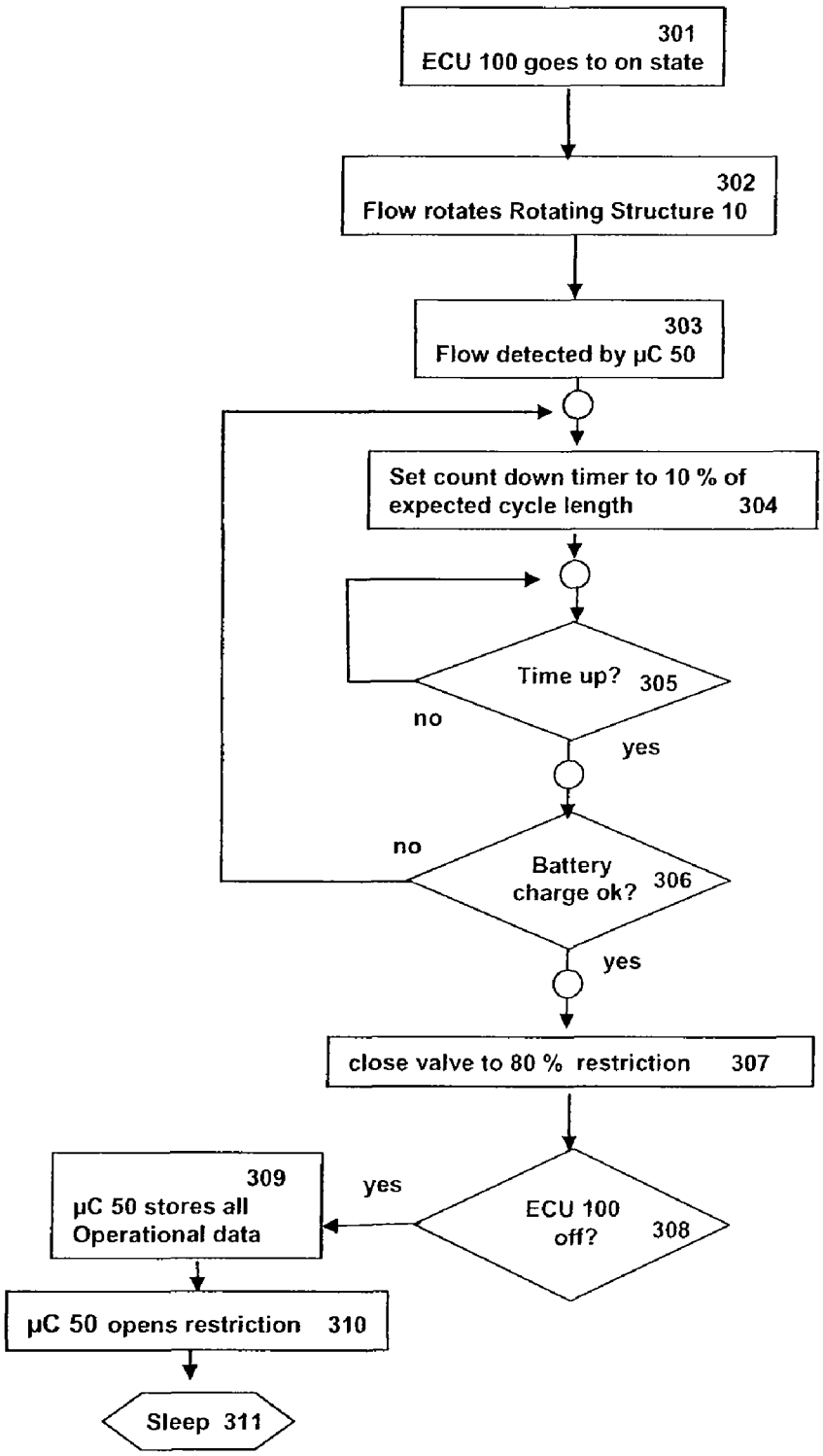
FIG. 30 is a flow chart of method steps for the operation of a flow control device performing an abandoned room function in a single unit installation application.

Although much of the discussion has revolved around the use of multiple cooperating units in a system, it is possible to satisfy certain user needs or preferences using just a single intelligent autonomous device. In the case of a room which is no longer in use, as is the case when children graduate or go off to school, the homeowner has as an unused room which continues to add to the household energy costs. Simply closing the manual vent in the room can have a detrimental effect on the contents of the room as the air becomes stale and in many environments humidity can build up. A preferred solution would be to place a single autonomous flow control unit 5 in the ductworks 2 supplying the unused room with a programmed set of instructions to minimize the airflow, but flush the air in the room at least once per day to prevent the build up of stale air or humidity. An example of an unused room process flow is illustrated in FIG. 30. As in a previous example the flow control unit 5 is dormant until the environmental control unit 100 moves to the "on" state and the flow of air in the ductworks rotates the rotating structure and is detected by the microcontroller 50, steps 301, 302, 303. To allow the room to be flushed briefly with fresh air, the microcontroller 50 sets a watchdog timer to a length of time equal to 10% of the expected environmental unit 100 cycle time, step 304, 305 FIG. 30. At the completion of that time period, the microcontroller tests to see that the power source or battery is in a sufficiently full state, step 306, and if so, proceeds to close the valve restriction device to 80%, step 307. The microcontroller then moves into a watch and wait state for the environmental control unit to cycle off, step 308. As soon as the environmental unit cycles off, the microcontroller saves the operational data from the current cycle including cycle length, step 309, opens the restriction device, step 310, and transitions into a low power sleep state waiting for the next environmental unit 100 cycle to begin step 311. By executing this simple code, a single flow control unit can reduce the energy expended in a single unused room by 70% or more depending on the exact variables chosen.

Although the descriptions above contain many specifications, these should not be construed as limiting the scope of the invention but as merely providing illustrations of some of the presently preferred embodiments of this present invention. Persons skilled in the art will understand that the method and apparatus described herein may be practiced, including but not limited to, the embodiments described. Further, it should be understood that the invention is not to be unduly limited to the foregoing which has been set forth for illustrative purposes. Various modifications and alternatives will be apparent to those skilled in the art without departing from the true scope of the invention, as defined in the following claims. While there have been illustrated and described particular embodiments of the present invention, it will be appreciated that numerous changes and modifications will occur to those skilled in the art, and it is intended in the appended claims to cover those changes and modifications which fall within the true spirit and scope of the present invention.

While the foregoing is directed to embodiments of the present invention, other and further embodiments of the invention may be devised without departing from the basic scope thereof, and the scope thereof is determined by the claims that follow.

The invention claimed is:

1. A method for controlling an environmental condition in a first location and a second location, the method comprising:

placing a first flow control device within the first location and a second flow control device within the second location;

controlling the environmental condition in each location by autonomously controlling airflow through each flow control device;

sending a signal from the first flow control device to the second flow control device via a duct system that interconnects the flow control devices; and detecting the signal in the second flow control device and adjusting the airflow through the second flow control device.

2. The method of claim 1, wherein the signal is a pressure pulse.

3. The method of claim 2, wherein the pressure pulse is generated by a flow restriction member in the flow control device.

4. The method of claim 1, wherein the signal is detected by a power generating member in the flow control device.

5. The method of claim 1, wherein the signal is detected by a duct pressure sensor in the flow control device.

6. The method of claim 1, wherein the signal is an acoustic tone.

7. The method of claim 1, wherein the environmental condition is controlled by communicating airflow from an environmental control unit to the locations via the duct system and the flow control devices.

8. The method of claim 7, further including communicating a back airflow from the second location to the first location via the duct system and the flow control devices when the environmental control unit is off.

9. The method of claim 8, wherein a power generating member in the second flow control device is utilized to communicate the back airflow into the duct system from the second location.

10. The method of claim 8, further including detecting the back airflow in the duct system and causing the first flow control device to increase the airflow into the first location.

11. The method of claim 8, further including actuating the environmental control unit upon detection of the back airflow.

12. The method of claim 1, further including monitoring a pressure in the duct system and adjusting the airflow through the flow control devices upon detection of a predetermined pressure.

13. The method of claim 1, wherein the environmental condition is humidity, temperature, or combinations thereof.

14. A system for controlling an environmental condition in a first location and a second location, the system comprising:

a first flow control device and a first sensor member disposed within the first location, the first sensor member configured to sense and send environmental data regarding the first location to the first flow control device; and a second flow control device and a second sensor member disposed within the second location, the second sensor member configured to sense and send environmental data regarding the second location to the second flow control device, wherein each flow control device includes a flow restriction member and a controller member configured to autonomously actuate the flow restriction member, wherein each flow control device is interconnected via a duct system, and wherein each flow control device is configured to communicate with the other flow control device by generating and sending pressure pulses via the duct system.

15. A system for controlling an environmental condition in a first location and a second location, the system comprising:

a first flow control device and a first sensor member disposed within the first location, the first sensor member configured to sense and send environmental data regarding the first location to the first flow control device; and a second flow control device and a second sensor member disposed within the second location, the second sensor member configured to sense and send environmental data regarding the second location to the second flow control device, wherein each flow control device includes a flow restriction member and a controller member configured to autonomously actuate the flow restriction member, wherein each flow control device is interconnected via a duct system, and wherein each flow control device is configured to communicate with the other flow control device by generating and sending an acoustic tone via the duct system.

16. The system of claim 14, wherein the controller member in each flow control device is capable of being programmed to follow a predetermined sequence.

17. The system of claim 14, wherein the controller member in each flow control device is configured to receive functional requests sent from a remote device.

* * * * *

UNITED STATES PATENT AND TRADEMARK OFFICE

CERTIFICATE OF CORRECTION

PATENT NO. : 8,348,732 B2
APPLICATION NO. : 11/610625
DATED : January 8, 2013
INVENTOR(S) : Aronstam et al.

It is certified that error appears in the above-identified patent and that said Letters Patent is hereby corrected as shown below:

Column 15, Line 61, please delete "5a" and insert --5b-- therefor;

Column 15, Line 64, please delete "5a" and insert --5b-- therefor.

Signed and Sealed this
Ninth Day of April, 2013

Teresa Stanek Rea
*Acting Director of the United States Patent and Trademark Office*